US012173496B2

(12) United States Patent
Koh

(10) Patent No.: US 12,173,496 B2
(45) Date of Patent: Dec. 24, 2024

(54) MOBILE OFFICE STRUCTURE

(71) Applicant: Tuang-Hock Koh, Taichung (TW)

(72) Inventor: Tuang-Hock Koh, Taichung (TW)

(73) Assignee: HARVEST-EXCEL INTERNATIONAL PTE. LTD. (TW)

( * ) Notice: Subject to any disclaimer, the term of this patent is extended or adjusted under 35 U.S.C. 154(b) by 188 days.

(21) Appl. No.: 18/113,057

(22) Filed: Feb. 23, 2023

(65) Prior Publication Data

US 2024/0287788 A1 Aug. 29, 2024

(51) Int. Cl.
*E04B 1/343* (2006.01)
*E04B 1/58* (2006.01)

(52) U.S. Cl.
CPC ..... *E04B 1/34384* (2013.01); *E04B 1/34326* (2013.01); *E04B 1/5831* (2013.01); *E04B 2001/5887* (2013.01)

(58) Field of Classification Search
CPC ..... E04B 1/34384; E04B 1/34326; E04B 1/5831; E04B 2001/5887; E04B 1/34357; F24F 13/32
See application file for complete search history.

(56) References Cited

U.S. PATENT DOCUMENTS

2009/0056248 A1* 3/2009 Pflum ..... F24F 3/0442 52/220.1
2020/0018060 A1* 1/2020 Watanabe ..... E04B 1/34326
2024/0287789 A1* 8/2024 Koh ..... E04B 1/5831

FOREIGN PATENT DOCUMENTS

CN 110821214 A * 2/2020 ..... E04B 1/34326
DE 202023100862 U1 * 4/2023 ..... E04B 1/34326
KR 2052732 B1 * 12/2019 ..... E04B 1/34315
TW M643734 U * 2/2023

* cited by examiner

*Primary Examiner* — Babajide A Demuren

(57) ABSTRACT

A mobile office structure and comprises a base frame set including multiple first base frames and multiple second base frames. Multiple wheel sets are connected to the underside of each of the second base frames. A top frame set includes multiple first top frames and multiple second top frames. Multiple upright frames are located at four corners of a combination of the base frame sets and the top frame sets. Multiple separators are respectively connected between any two of the upright frames. Multiple linings are assembled between any of the two upright frames, and each lining is located corresponding to the inside of each of the separators. Multiple outer plates are assembled between any of the two upright frames, and each outer plate is located relative to the outside of each of the separators. A door plate assembly is installed between the base frame set and the top frame set.

10 Claims, 26 Drawing Sheets

MOBILE OFFICE STRUCTURE

BACKGROUND OF THE INVENTION

1. Fields of the Invention

The present invention relates to a mobile office structure, and more particularly, to a mobile office structure that can be assembled according individual user's needs.

2. Descriptions of Related Art

Since the start of 2020, the world has faced the greatest challenge of the new coronavirus (Covid-19). In order to prevent the spread of the epidemic, more and more people are choosing to work from home (WFH). According to a study by IDC (International Data Corporation), there are already over 45 million professional business people worldwide who need to work outside of the office. In 2021, Microsoft's work trend index report also indicated that over 66% of employees in Taiwan hope to maintain remote work patterns, and many business owners have begun to adopt a "hybrid work" model that combines physical and online work.

The present invention intends to provide a mobile office structure to eliminate shortcomings mentioned above.

SUMMARY OF THE INVENTION

The primary object of the present invention is to provide a mobile office structure that can be assembled easily and quickly without special tools needed, and meets individual user's needs.

The present invention relates to a mobile office structure and comprises a base frame set including a plurality of first base frames and a plurality of second base frames mutually perpendicular and horizontally arranged. A plurality of wheel sets are connected to the underside of each of the second base frames. Atop frame set includes a plurality of first top frames and a plurality of second top frames that are mutually perpendicular and horizontally arranged. Multiple upright frames are located at four corners of a combination of the base frame sets and the top frame sets. Multiple separators are respectively connected between any two of the upright frames. Multiple linings are assembled between any of the two upright frames, and each lining is located corresponding to the inside of each of the separators. Multiple outer plates are assembled between any of the two upright frames, and each outer plate is located relative to the outside of each of the separators. A door plate assembly is installed between the base frame set and the top frame set.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
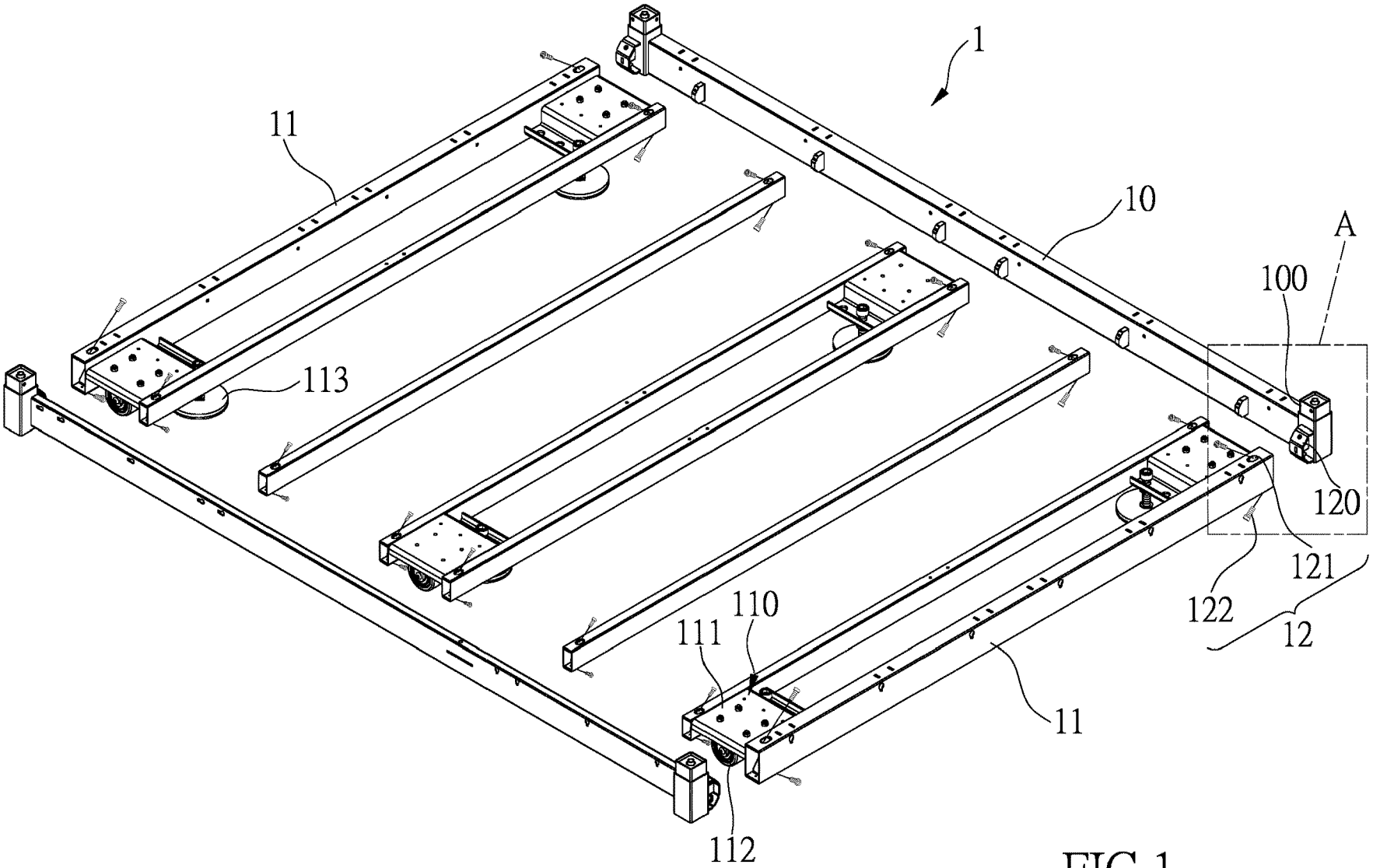
FIG. 1 is an exploded view of the base frame set of the present invention.
Figure 2:
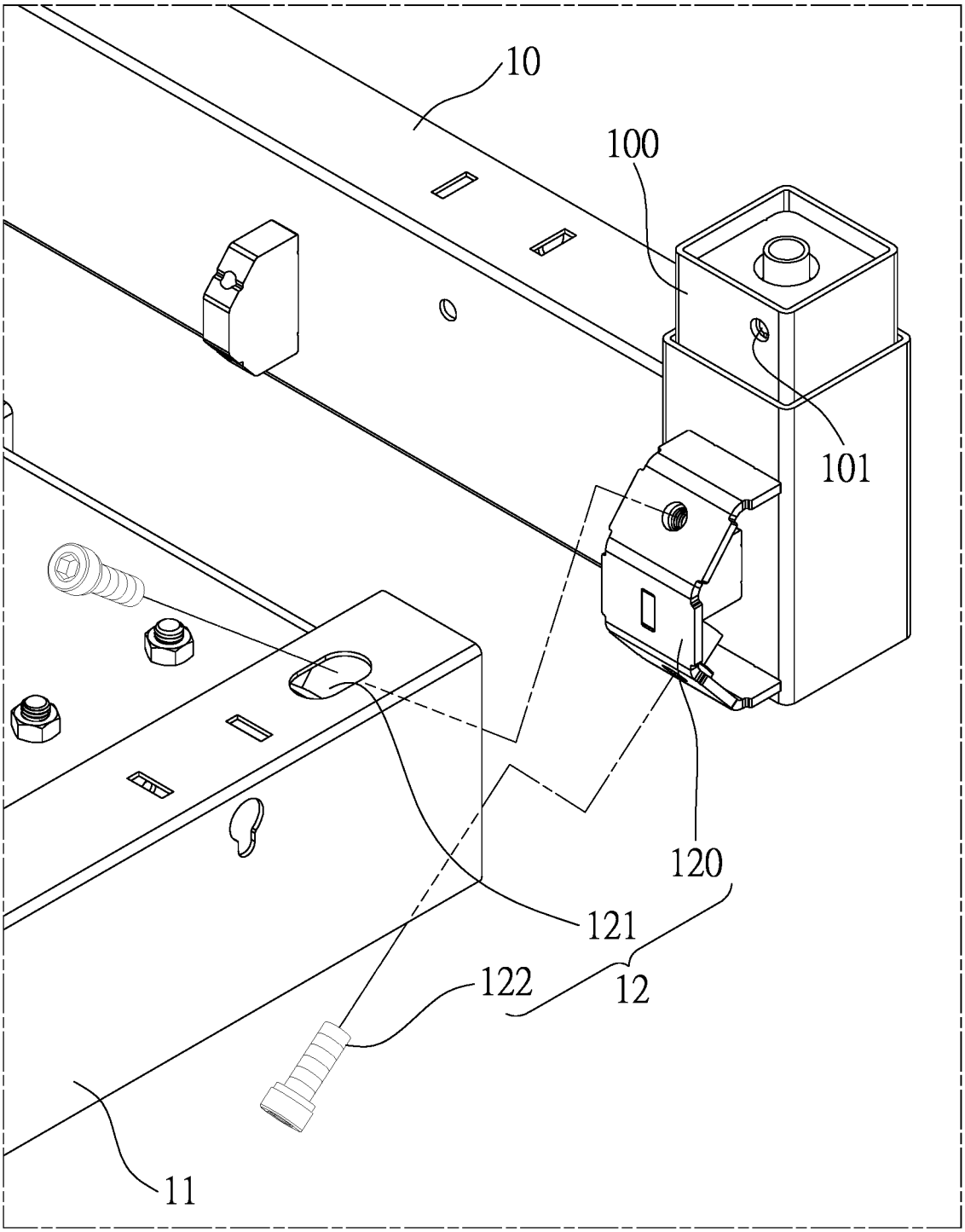
FIG. 2 is an enlarged view of the area "A" in FIG. 1.
Figure 3:
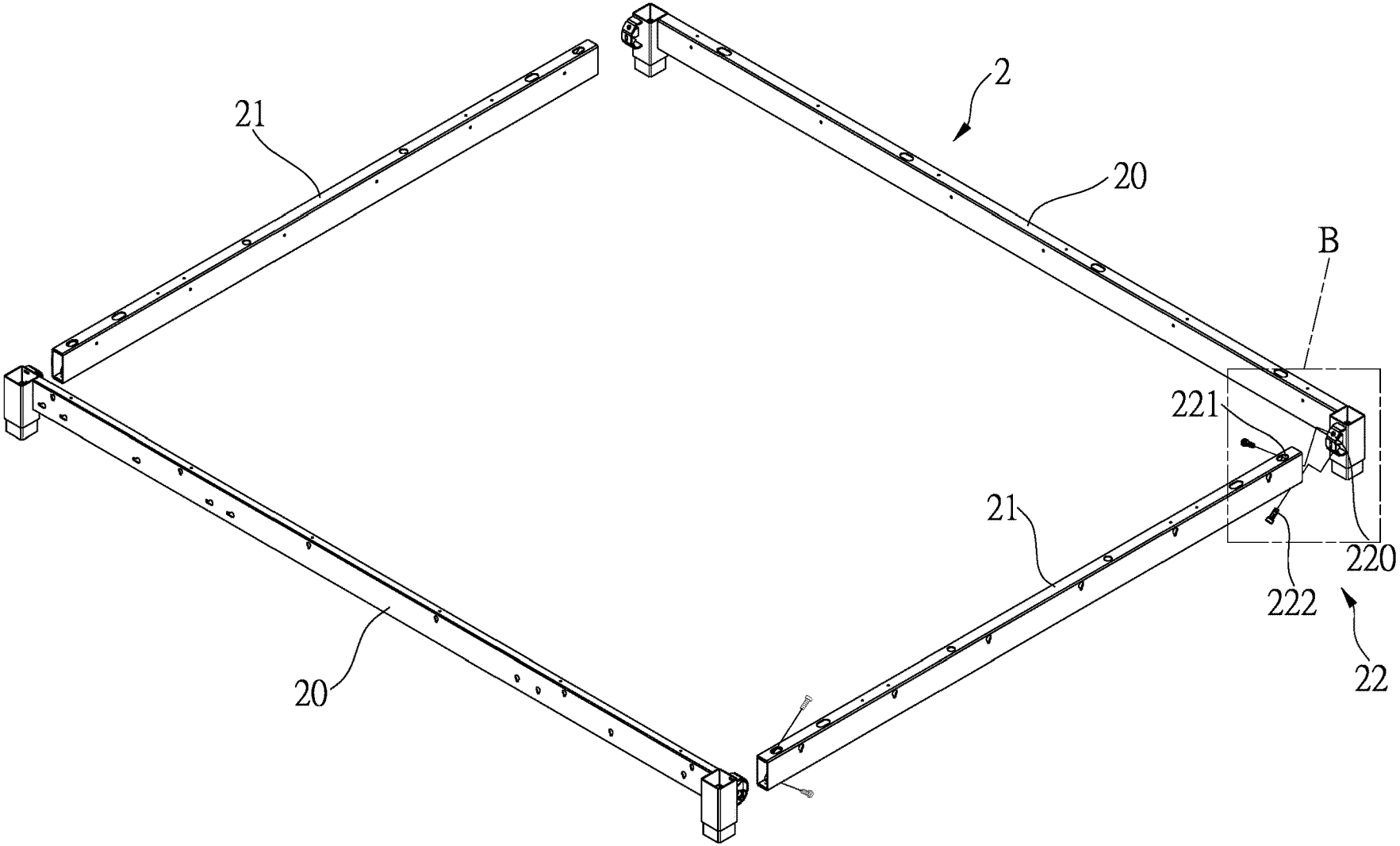
FIG. 3 is an exploded view of the top frame set of the present invention.
Figure 4:
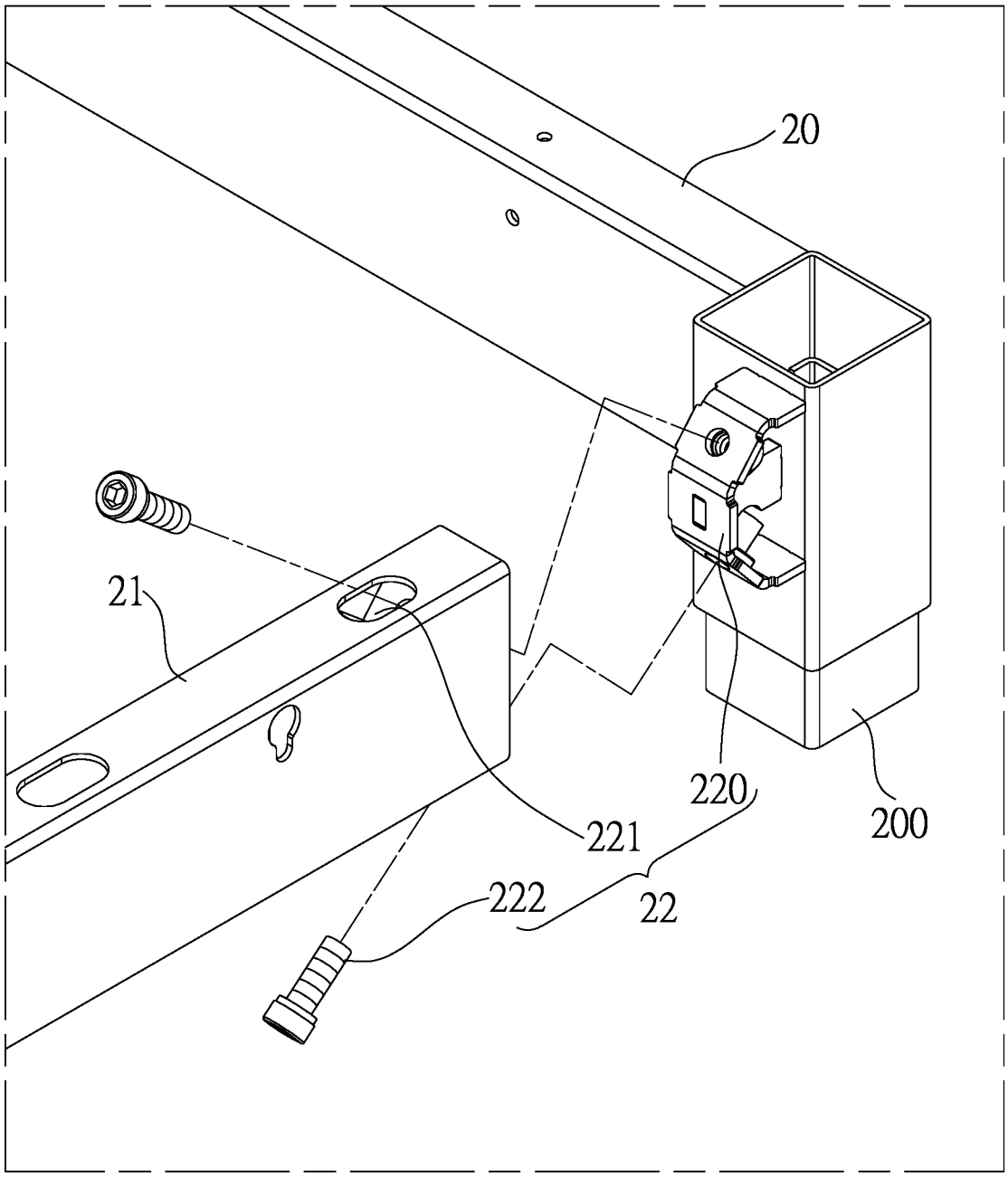
FIG. 4 is an enlarged view of the area "B" in FIG. 3.
Figure 5:
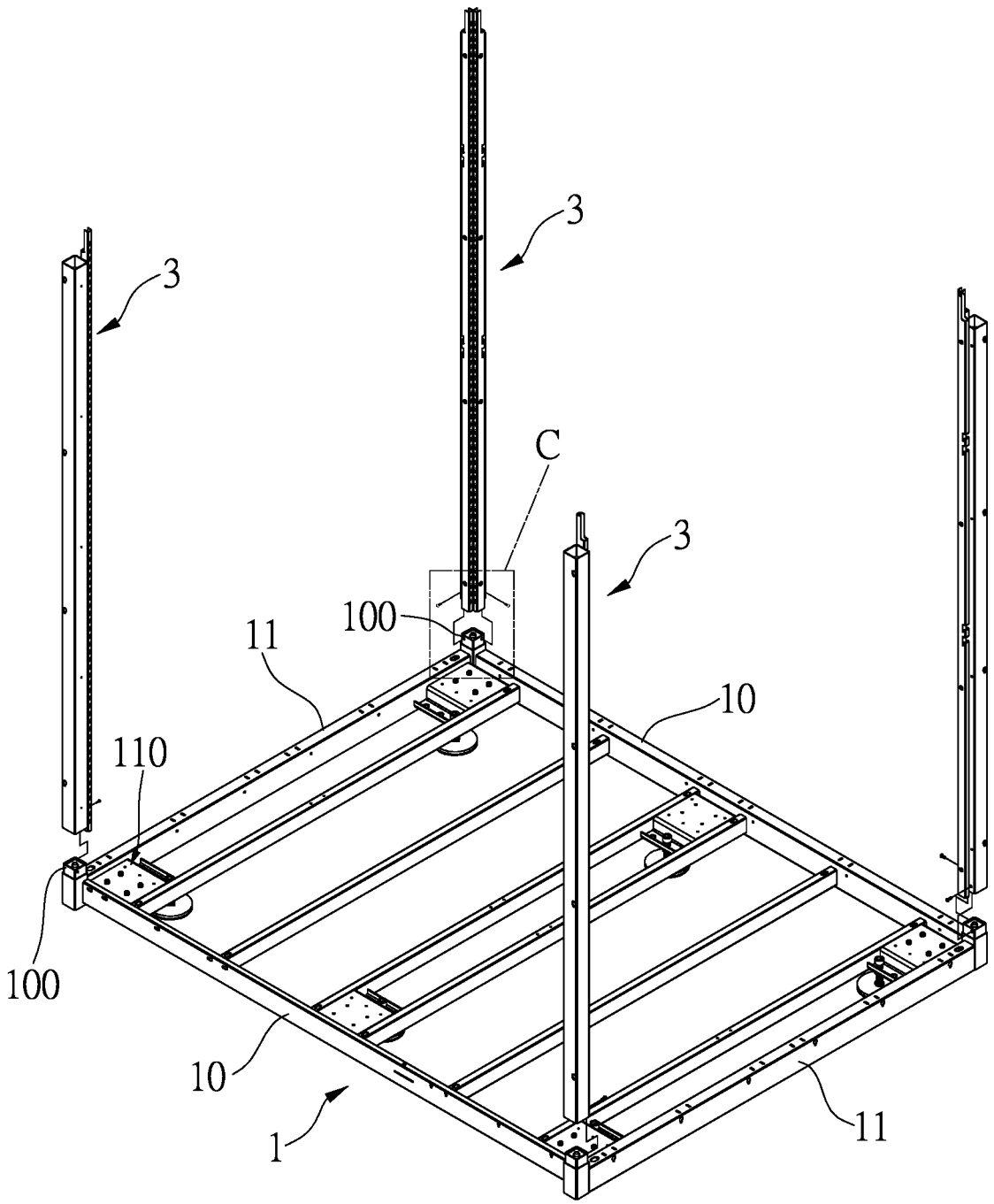
FIG. 5 is an exploded view of the upright frames and the base frame set of the present invention.
Figure 6:
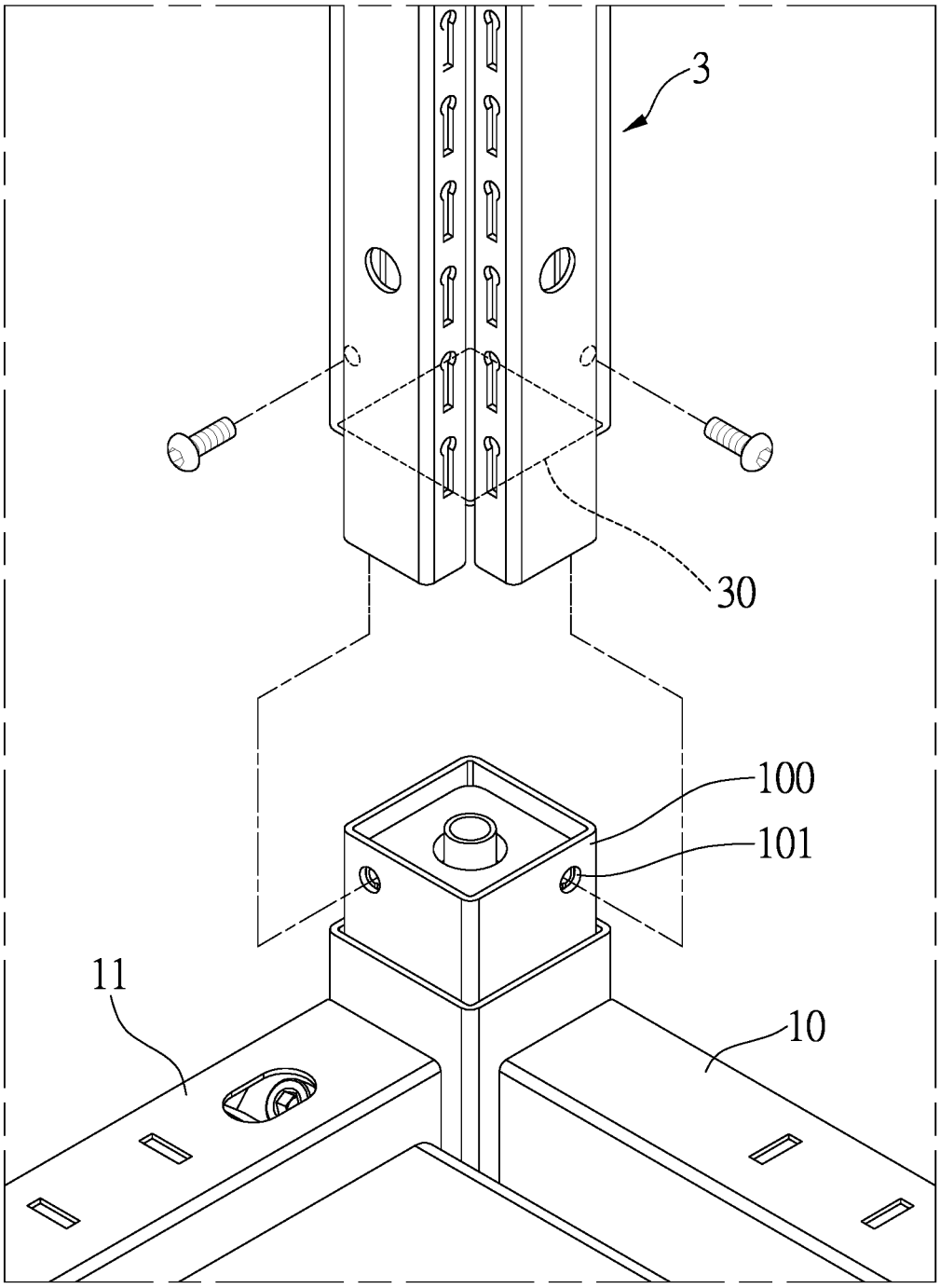
FIG. 6 is an enlarged view of the area "C" in FIG. 5.
Figure 7:
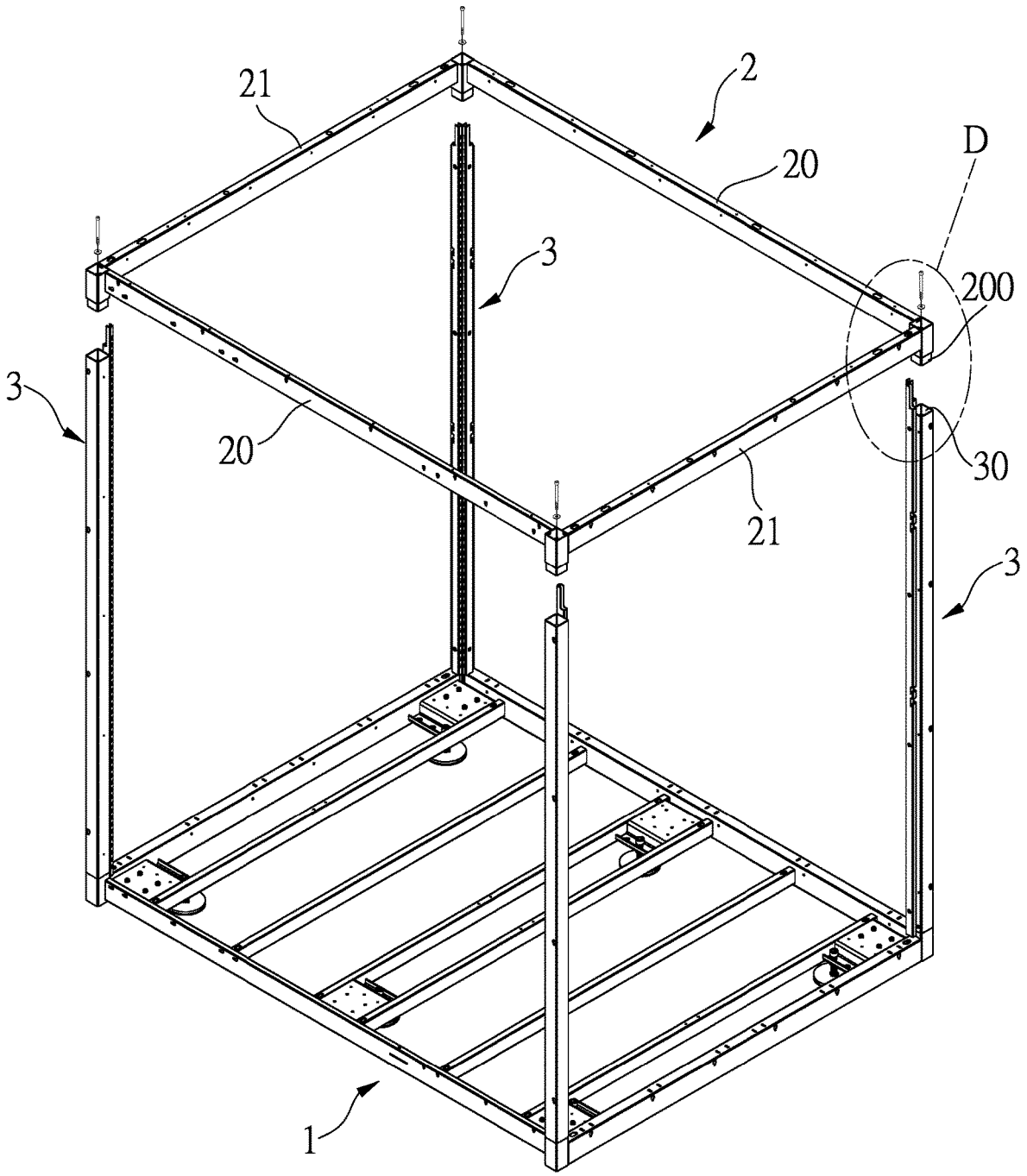
FIG. 7 is an exploded view of the upright frames and the top frame set of the present invention.
Figure 8:
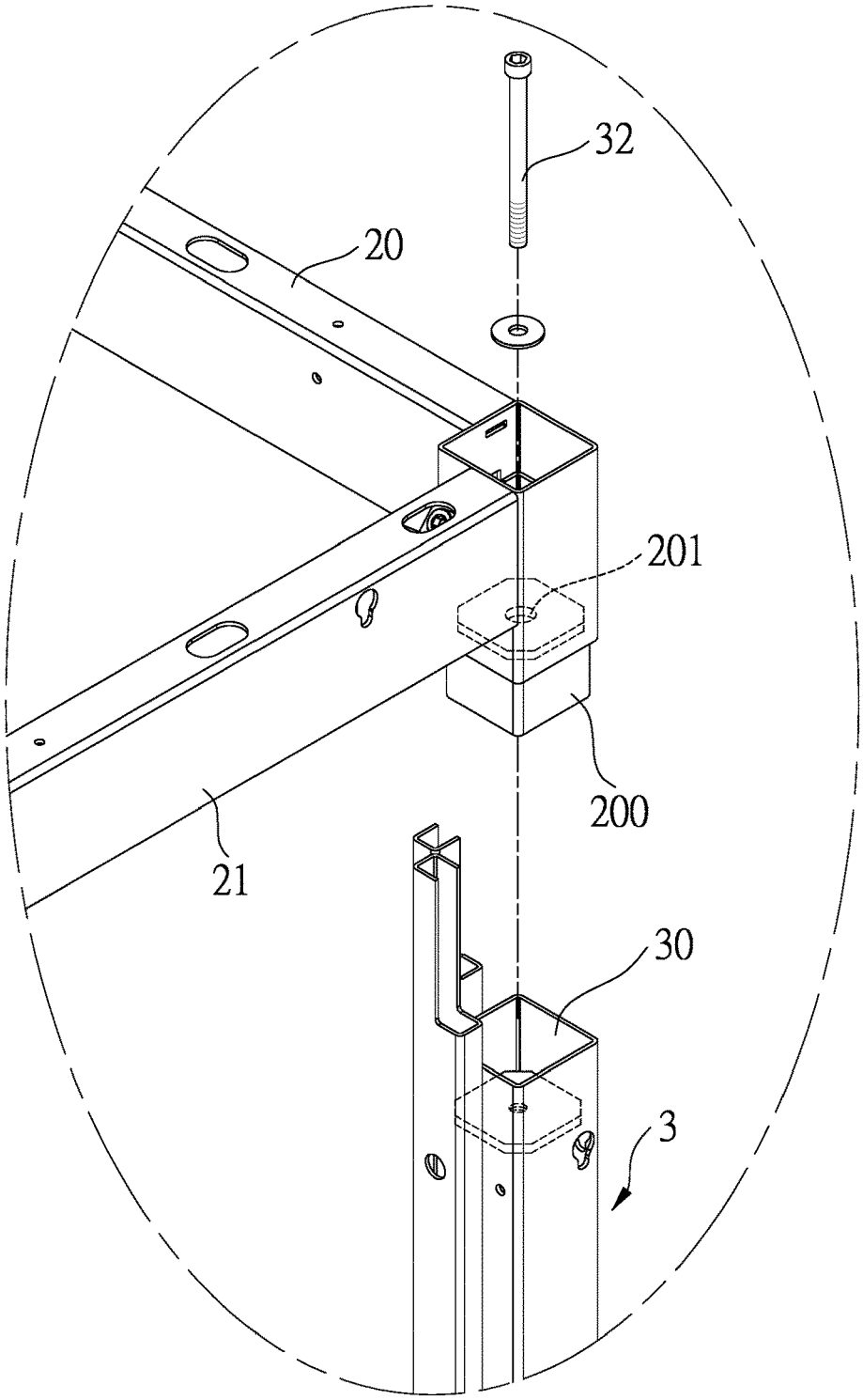
FIG. 8 is an enlarged view of the area "D" in FIG. 7.
Figure 9:
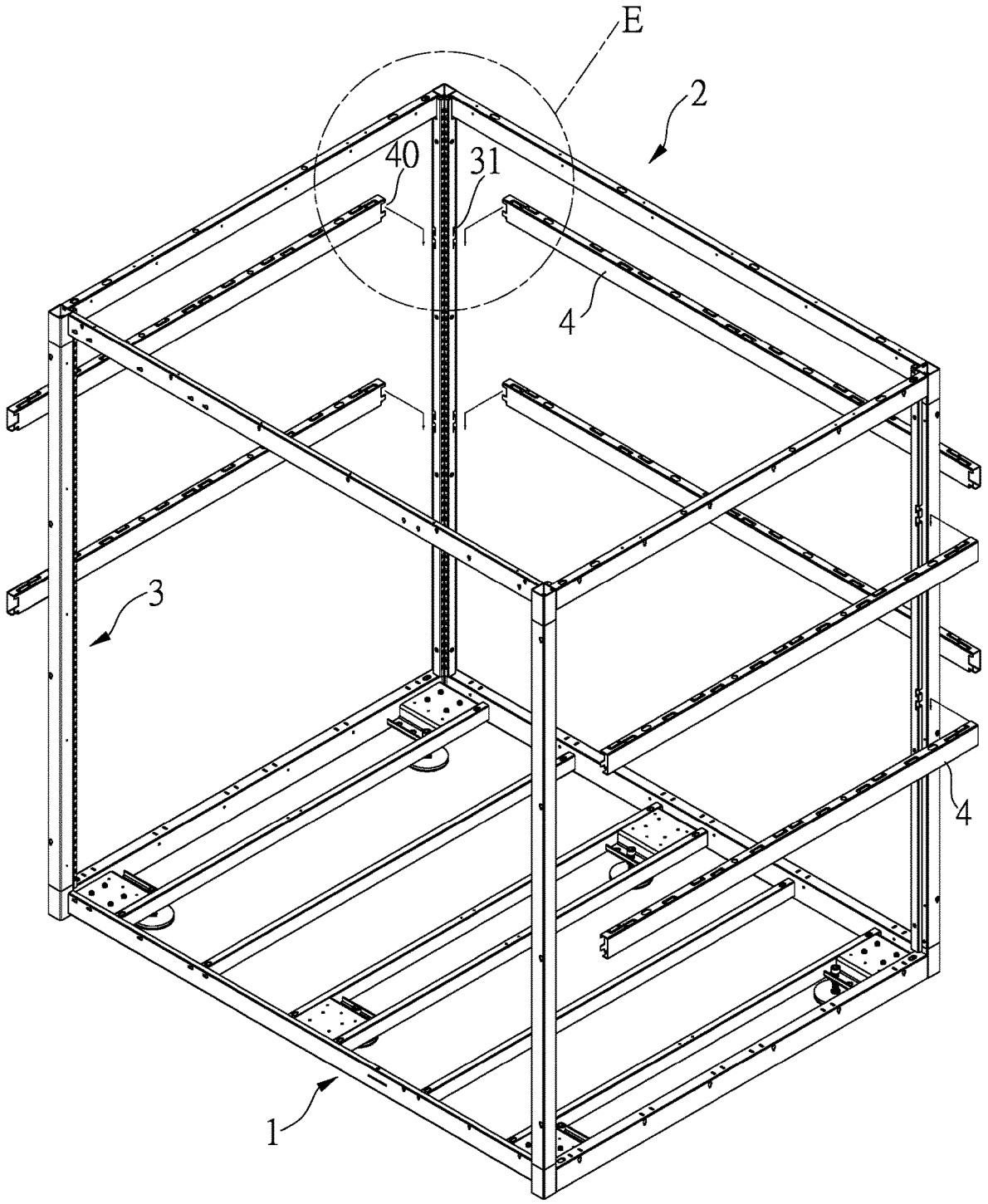
FIG. 9 is an exploded view of the upright frames and the separators of the present invention.
Figure 10:
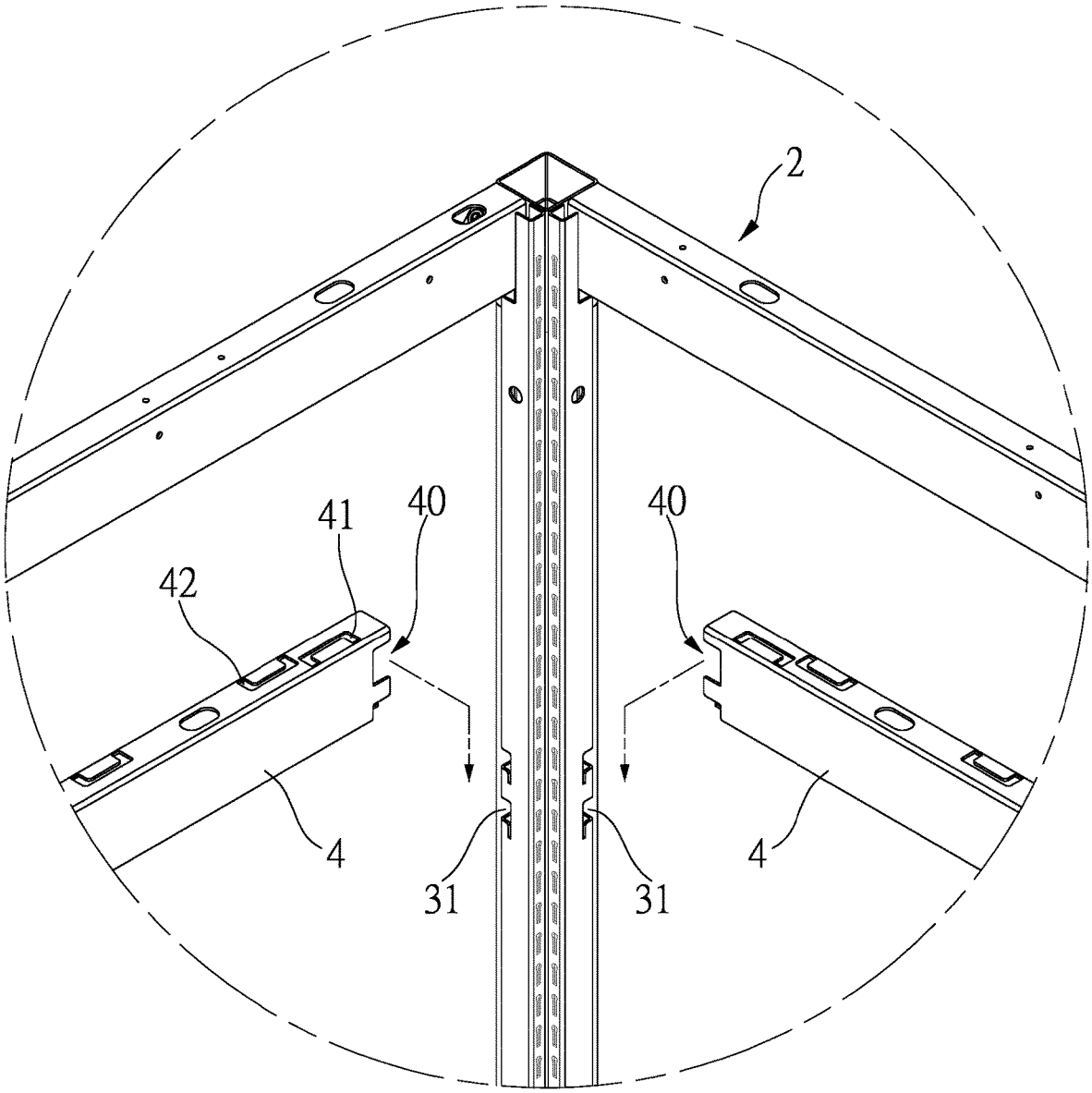
FIG. 10 is an enlarged view of the area "E" in FIG. 9.
Figure 11:
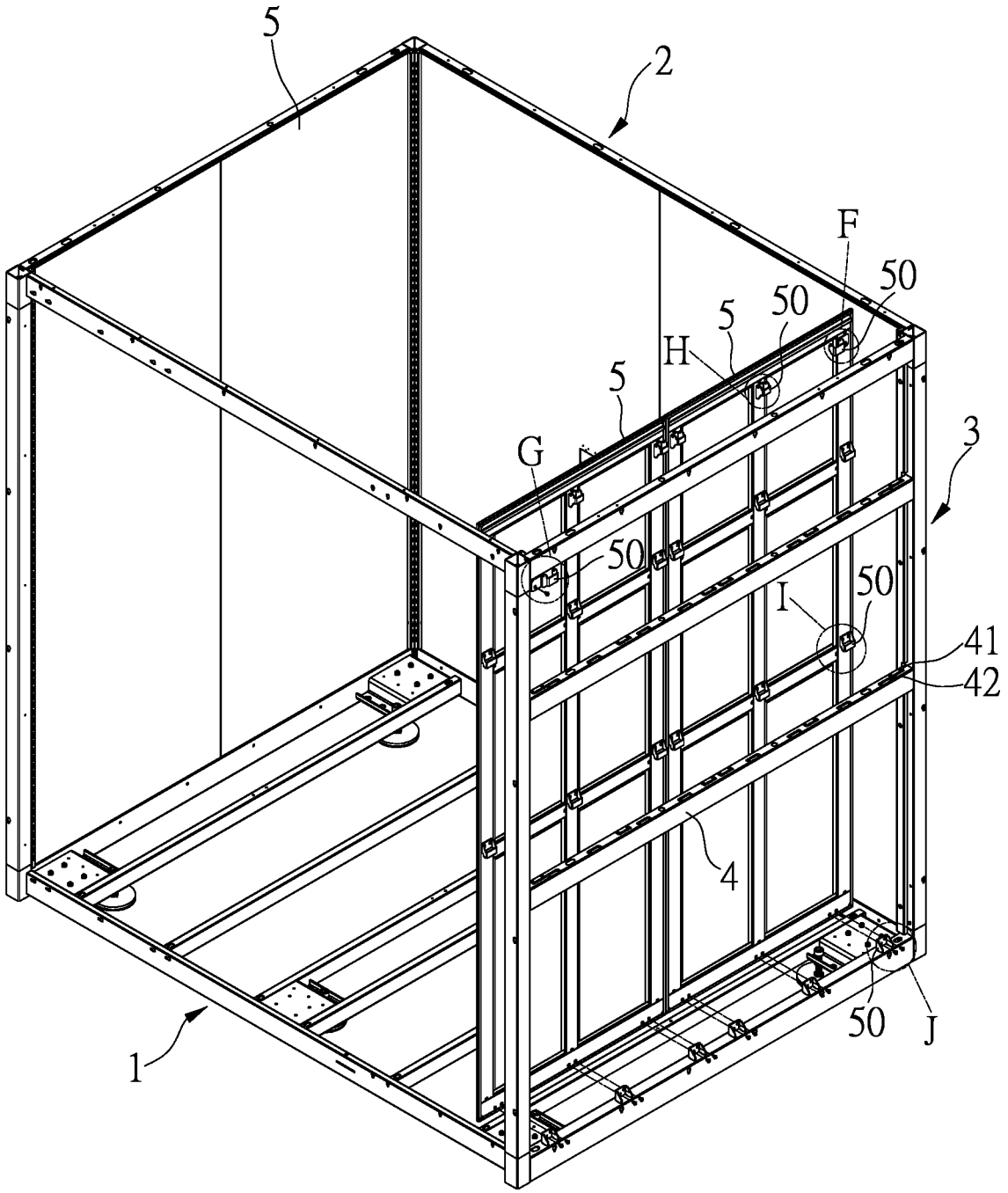
FIG. 11 is an exploded view of the linings and the separators of the present invention.
Figure 12:
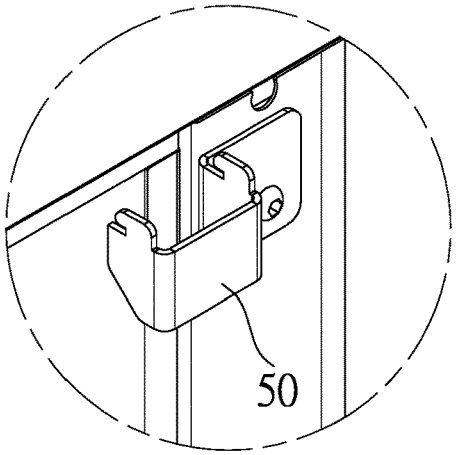
FIG. 12 is an enlarged view of the area "F" in FIG. 11.
Figure 13:
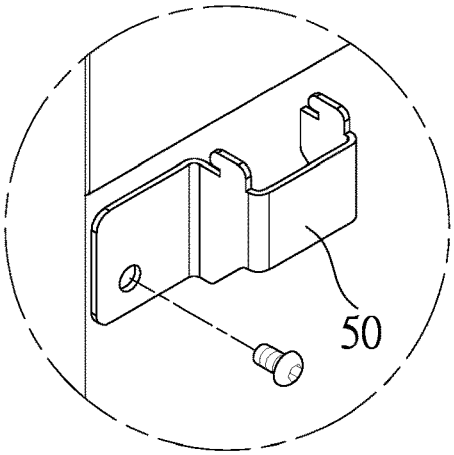
FIG. 13 is an enlarged view of the area "G" in FIG. 11.
Figure 14:
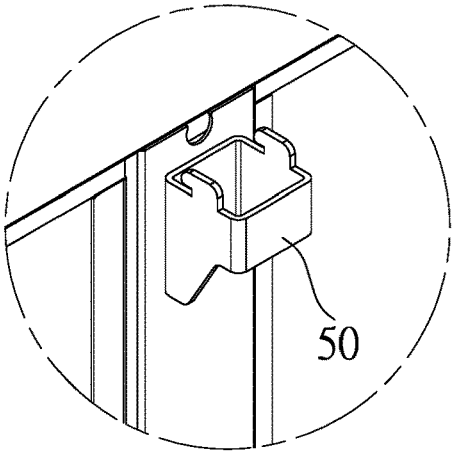
FIG. 14 is an enlarged view of the area "H" in FIG. 11.
Figure 15:
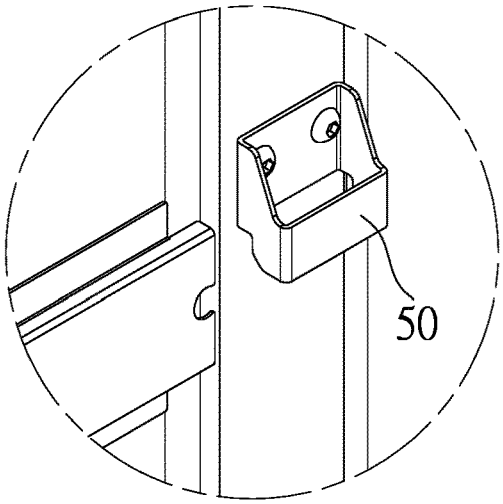
FIG. 15 is an enlarged view of the area "I" in FIG. 11.
Figure 16:
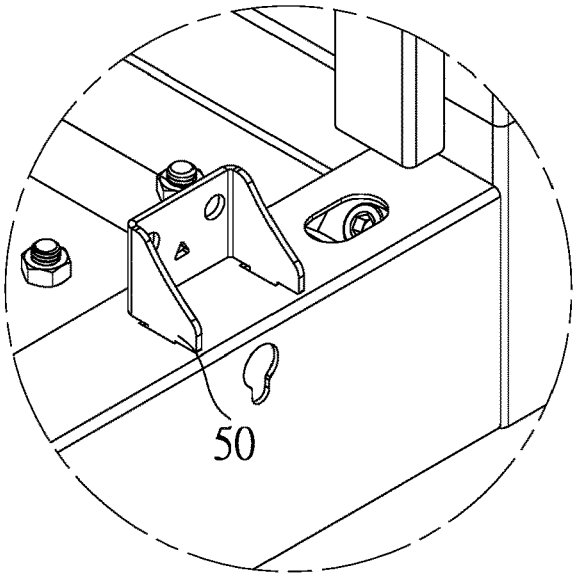
FIG. 16 is an enlarged view of the area "J" in FIG. 11.

Referring to FIGS. 1 to 29, the mobile office structure of the present invention comprises a base frame set 1 which includes a plurality of first base frames 10 and a plurality of second base frames 11 mutually perpendicular and horizontally arranged. Each of the first base frames 10 has a first end part 100 protruding upward from each of two ends thereof. The first end parts 100 each have a first positioning hole 101.

A plurality of first fastening components 12 each have a first fastening seat 120 formed on the first base frame 10, a first fastening hole 121 formed to the second base frame 11, and a first bolt 122 extending through the first fastening hole 121 and connected to the first fastening seat 120.

A top frame set 2 includes a plurality of first top frames 20 and a plurality of second top frames 21 that are mutually perpendicular and horizontally arranged. Each of the first top frames 20 having a second end part 200 protruding downward from each of two ends thereof. The second end parts 200 each include a second positioning hole 201.

A plurality of second fastening components 22 each have a second fastening seat 220 formed on the first top frame 20, a second fastening hole 221 formed to the second top frame 21, and a second bolt 222 extending through the second fastening hole 221 and connected to the second fastening seat 220.

A plurality of wheel sets 110 connected to an underside of each of the second base frames 11. Each of the wheel sets 110 includes a wheel seat 111 which has a wheel 112 and a disk 113 connected to the underside thereof.

Multiple upright frames 3 each have an opening 30 formed in each of two ends thereof. The two openings 30 are located corresponding to the first end part 100 and the second end part 200, the first and second end parts 100, 200 respectively inserted into the opening 30 corresponding thereto, so that the upright frames 3 are vertically assembled between the base frame sets 1 and the top frame sets 2, and are located at four corners of a combination of the base frame sets 1 and the top frame sets 2. Each upright frame 3 has multiple slots 31.

Multiple separators 4 each have a segment 40 that is connected to the slots 31 of each of the upright frames 3 so that each separator 4 is connected between the two upright frames 3. Each separator 4 has multiple first holes 41 and multiple second holes 42 formed in the top side thereof.

Figure 17:
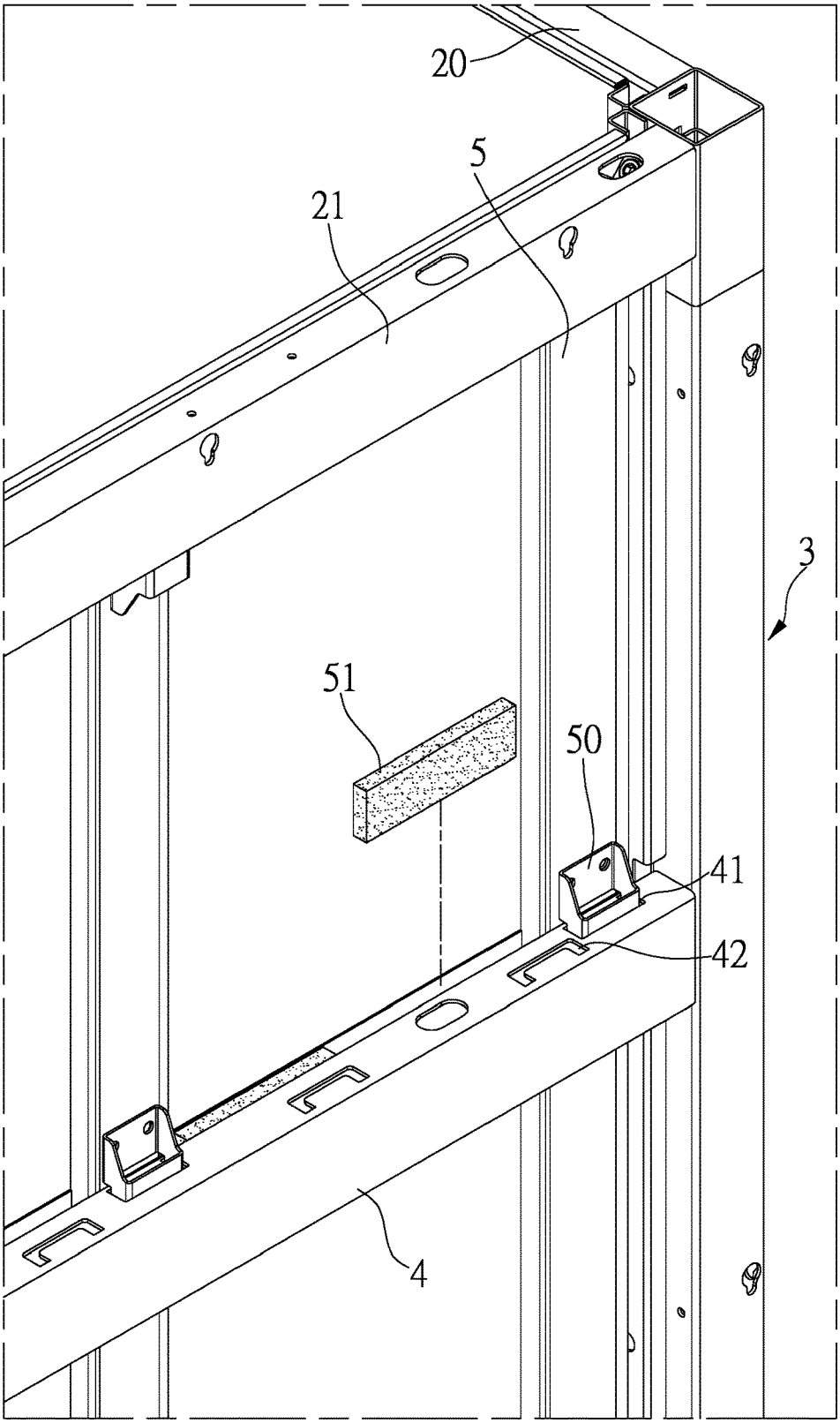
FIG. 17 is an enlarged view to show the first magnetic parts attached to the lining.
Figure 18:
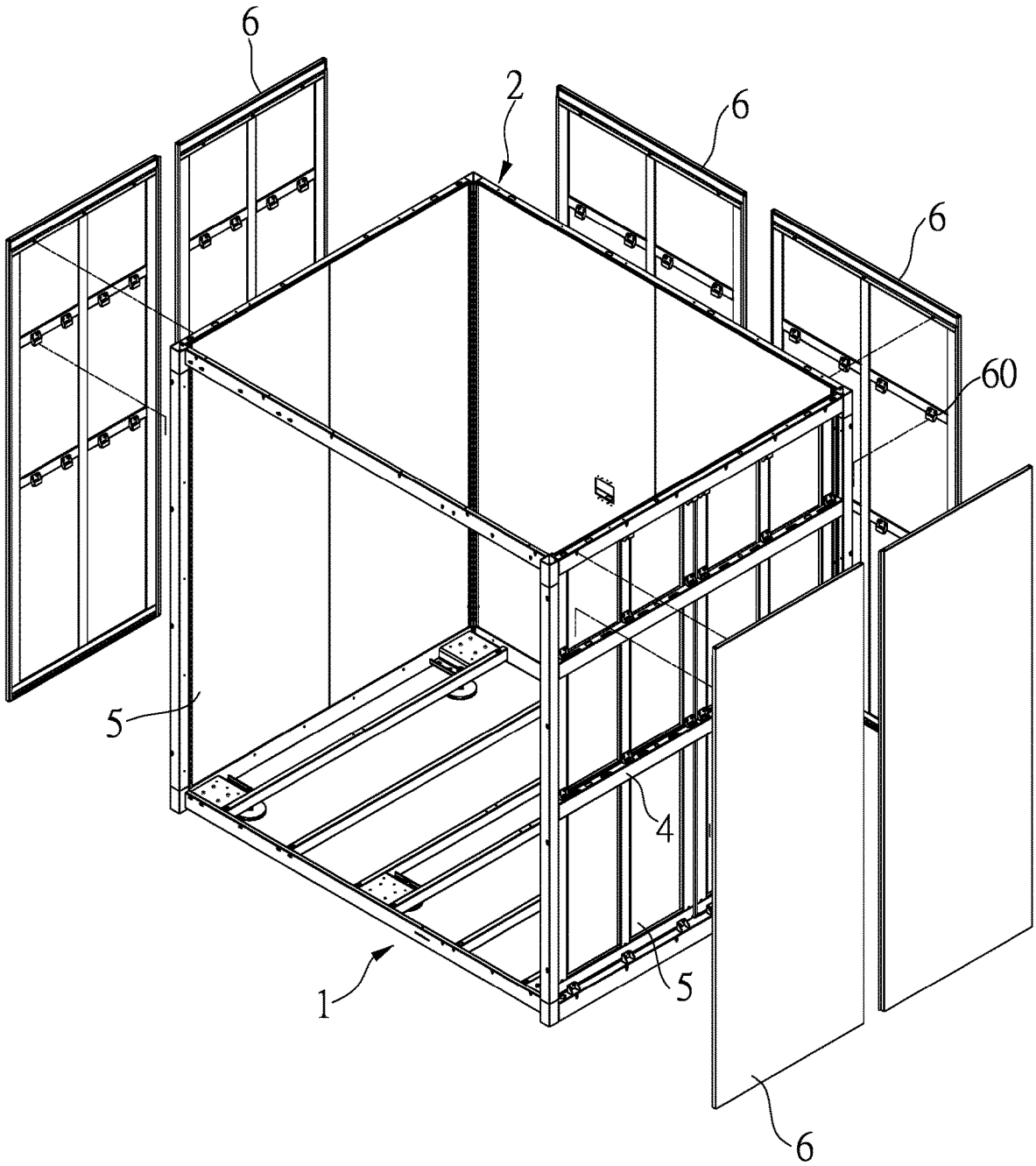
FIG. 18 is an exploded view of the outer plates and the separators of the present invention.
Figure 19:
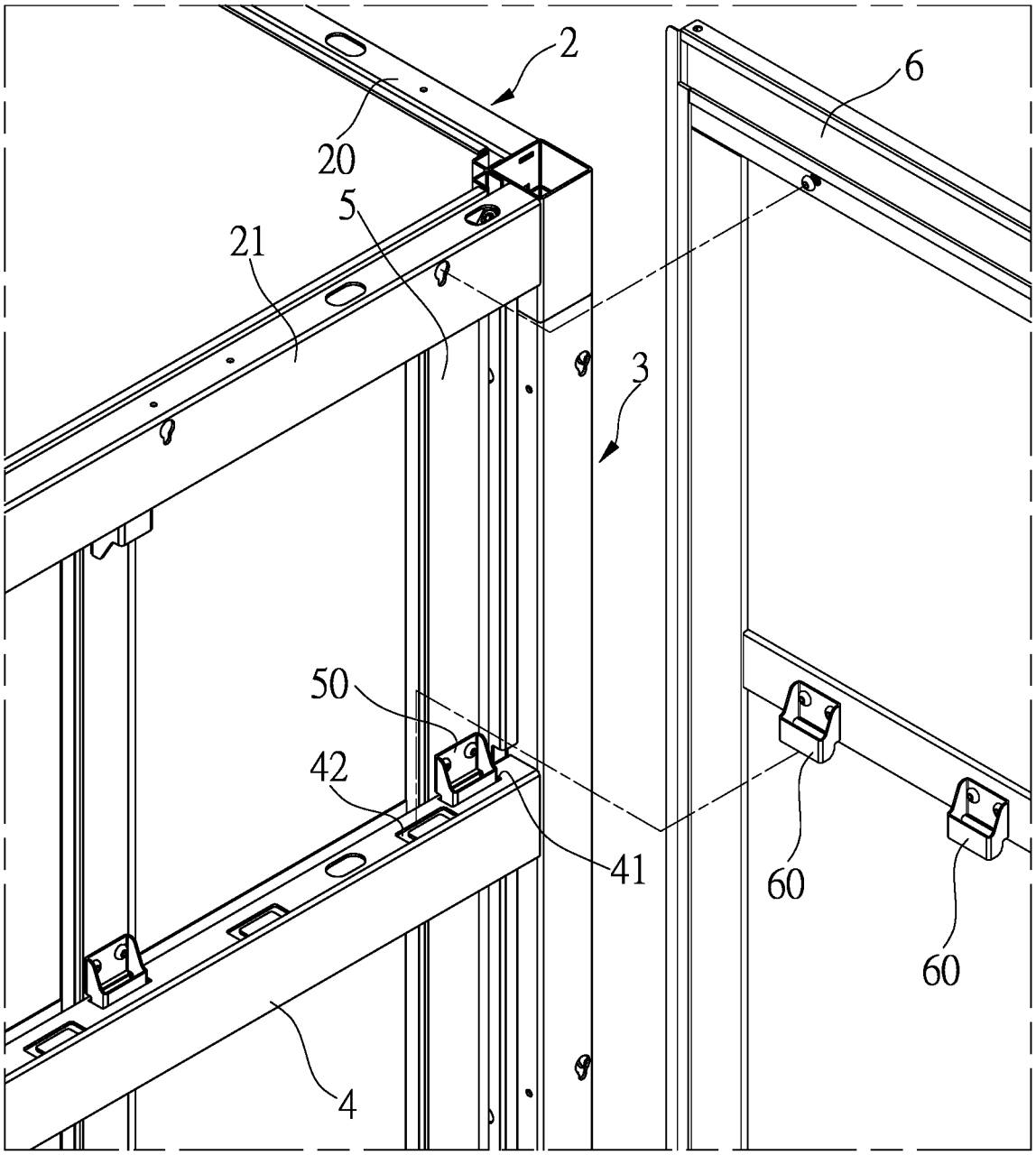
FIG. 19 is an enlarged view of the outer plates and the separators of the present invention.
Figure 20:
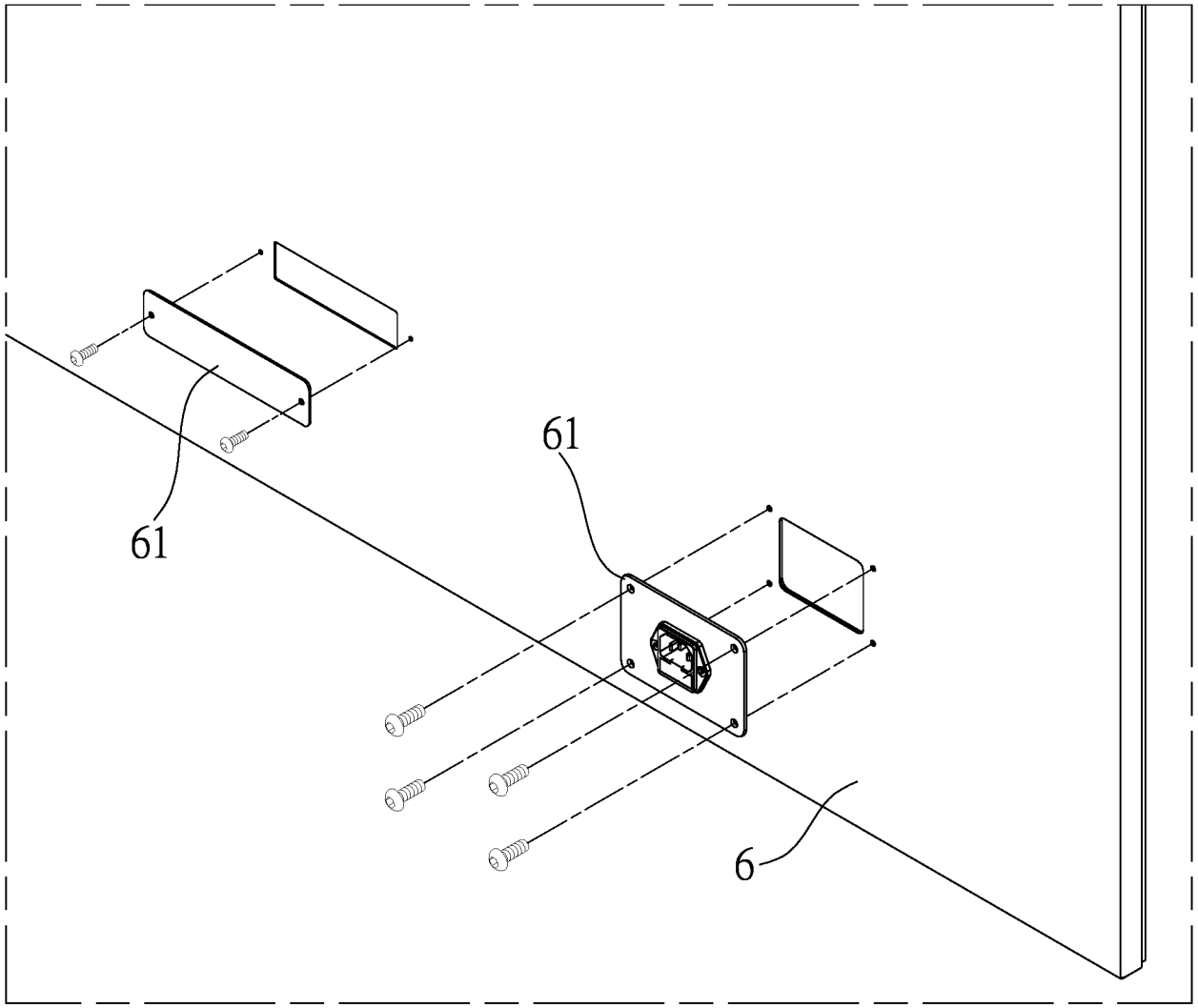
FIG. 20 is an enlarged view to show that the outer plate includes ports.

Multiple linings 5 each have multiple first blocks 50 which are engaged with the first holes 41 of the separator 4 corresponding thereto, so that each lining 5 is assembled between the two upright frames 3 and located corresponding to the inside of each separator 4. The first blocks 50 may have different structure as shown in FIGS. 12 to 16. Each lining 5 has multiple first magnetic parts 51 attached thereto as shown in FIG. 17.

Multiple outer plates 6 each have multiple second blocks 60 which are engaged with the second holes 42 corresponding thereto, so that each outer plate 6 is assembled between the two upright frames 3 and is located relative to an outside of each separator 4. Each outer plate 6 has multiple ports 61 formed to the outside thereof, and the ports 61 are used to be connected with communication parts.

Figure 29:
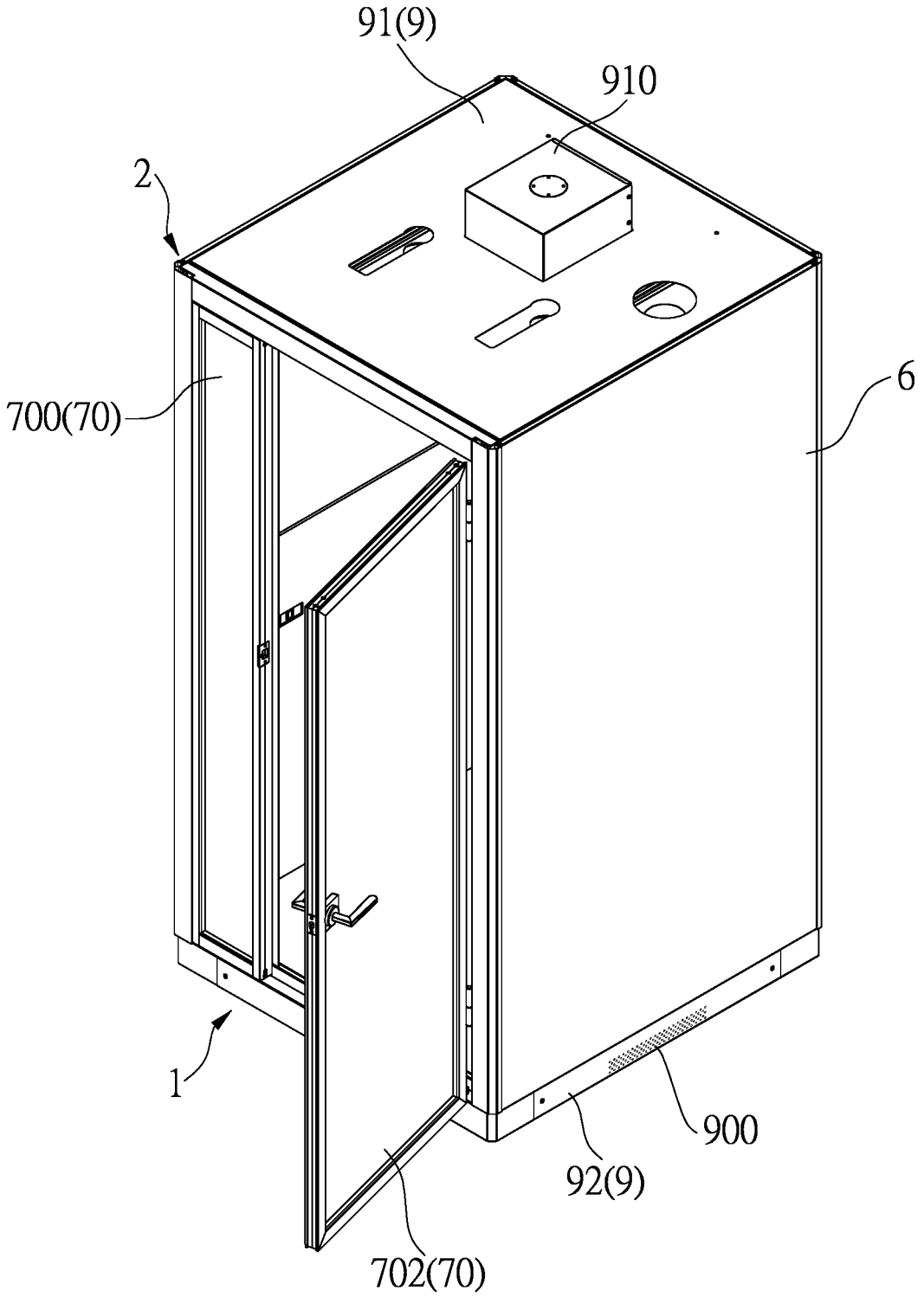
FIG. 29 shows that the mobile office includes two door plates.

A door plate set 7 includes multiple door plates 70 and an assembly component 71 that is installed between the base frame set 1 and the top frame set 2. As shown in FIGS. 21 to 28, the door plate set 7 may include three pieces. The door plates 70 include a first plate 700, a second plate 701 and a third plate 702. As shown in FIG. 29, the door plate set 7 may include two pieces, and includes a first plate 700 and a third plate 702.

Multiple inner plates 8 each include multiple second magnetic parts 80 which are located corresponding to the first magnetic parts 51 of the lining 5 corresponding thereto. The first and second magnetic parts 51, 80 magnetically attract each other to attach the inner plates 8 to an inside of the linings 5. Each of the inner plates 8 can be connected to an office component 81.

A blocking plate set 9 includes multiple first blocking plates 90, multiple second blocking plates 91 and multiple third blocking plates 92. Each of the first blocking plates 90 and each of the third blocking plates 92 includes multiple vents 900. Each of the second blocking plates 91 has multiple fire distinguishers 910.

When in assembling, the first base frames 10 and the second base frames 11 are connected with each other by the first fastening components 12. Specifically, the first bolt 122 extends through the first fastening hole 121 of the second base frame 11, and is connected to the first fastening seat 120 of the first base frame 10. Therefore, each first base frame 10 is perpendicularly connected to the second base frame 11. The top frames 21 and the second top frames 21 are connected to each other. Specifically, the second bolt 222 extends through the second fastening hole 221 of the second top frame 21, and is connected to the second fastening seat 220 of the first top frame 20. Therefore, each first top frame 20 is perpendicularly connected to the second top frame 21.

The two openings 30 of each upright frame 3 are mounted to the first end part 100 and the second part 200. A third bolt 32 is connected to the first positioning hole 101 of the first end part 100 and the second positioning hole 201 of the second end part 200. Therefore, the upright frames 3 are located at the four corners of the combination of the base frame sets 1 and the top frame sets 2.

The segments 40 on the two ends of each separator 4 are transversely inserted into the slots 31 of the upright frames 3 corresponding thereto. The first block 50 of each lining 5 is engaged with the first hole 41 of the separator 4 to position the lining 5 between the two upright frames 3 and located corresponding to the inside of the separator 4. The second block 60 of each outer plate 6 is engaged with the second hole 42 of the separator 4 to position the outer plate 6 between the two upright frame 3 and located corresponding to the outside of the separator 4.

The first and second magnetic parts 51, 80 magnetically attract each other to attach the inner plates 8 to the inside of the linings 5.

Figure 23:
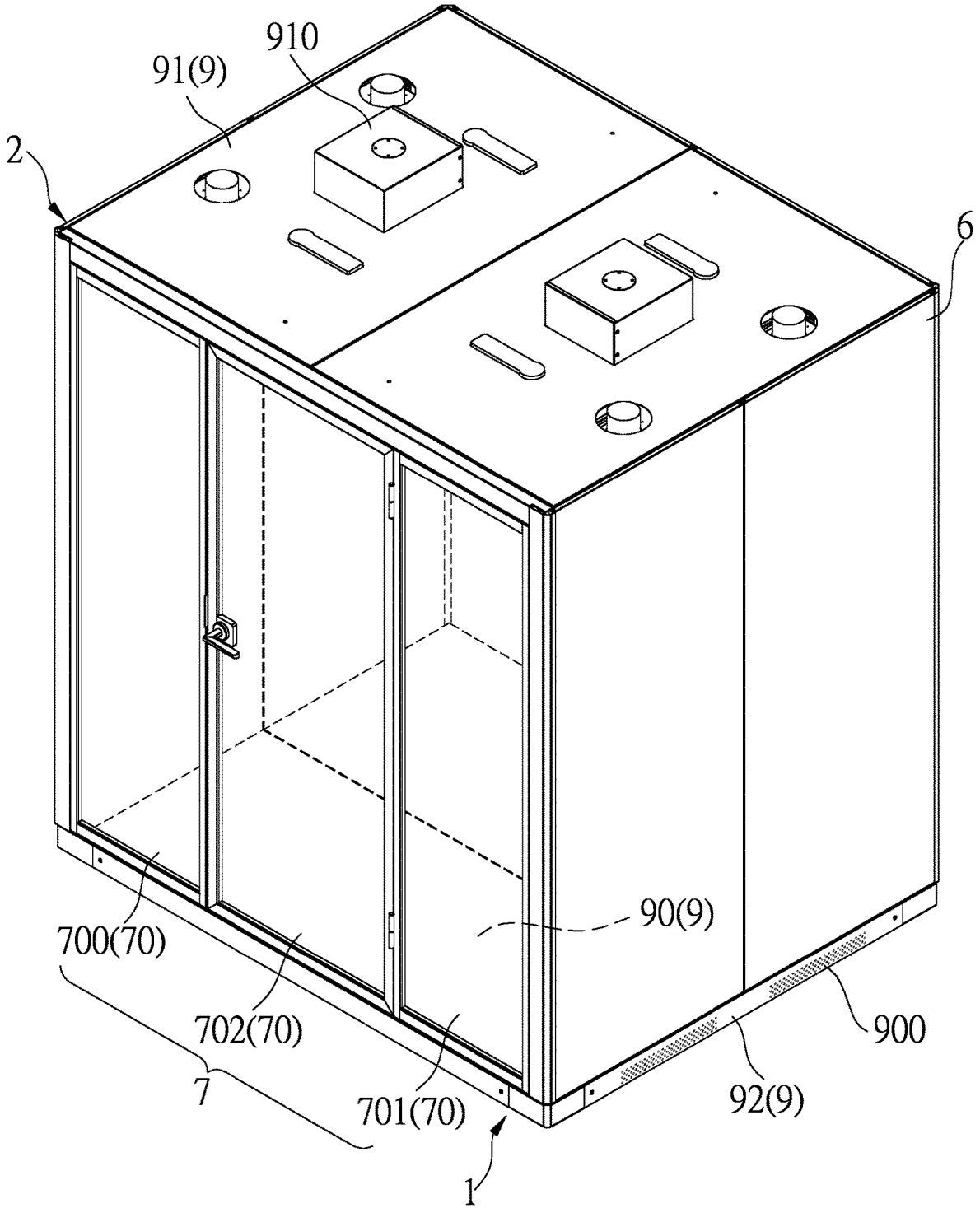
FIG. 23 shows the blocking plate set of the present invention.
Figure 24:
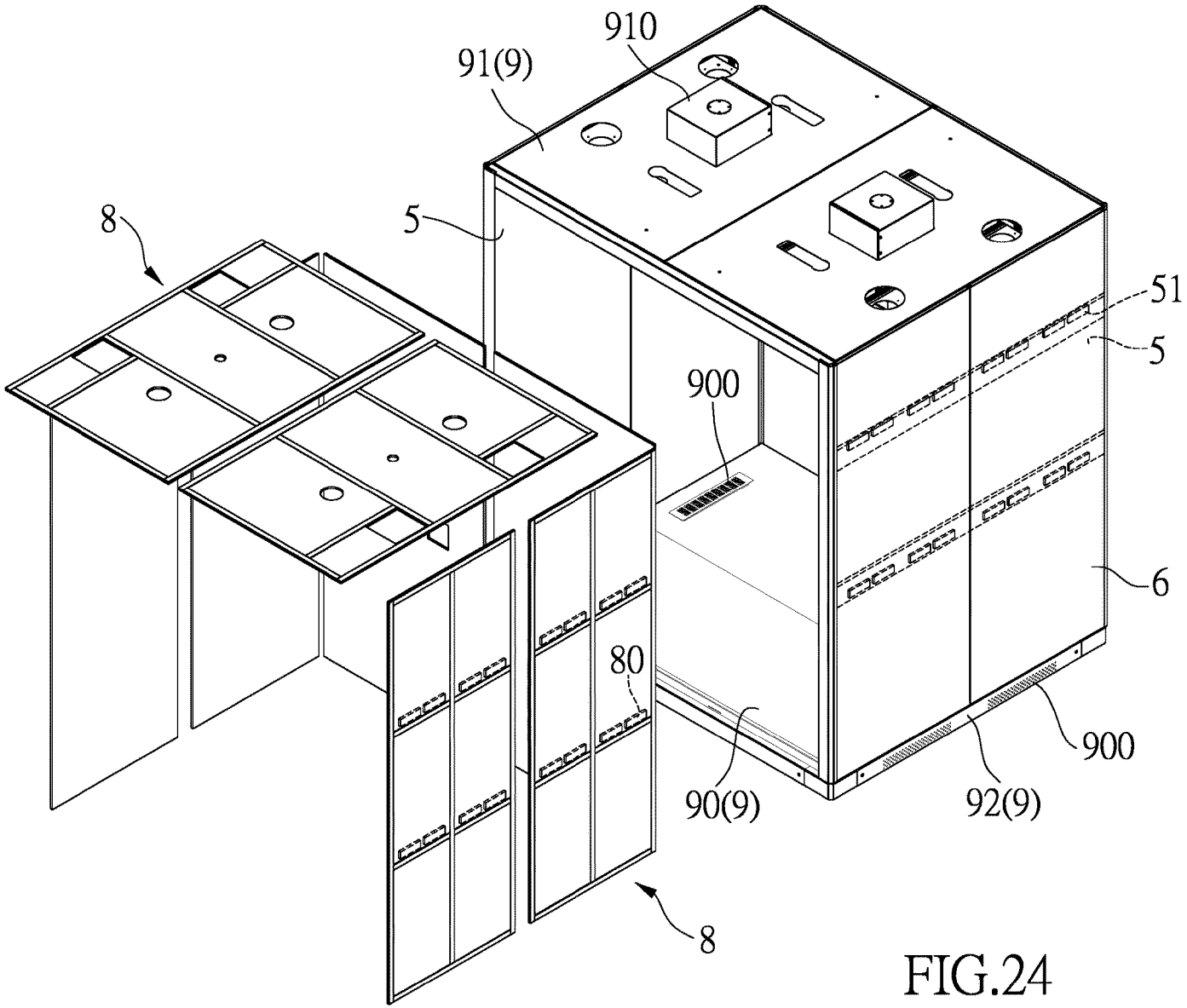
FIG. 24 is an exploded view of the linings and the inner plates of the present invention.

Each of the first blocking plates 90 and each of the third blocking plates 92 are respectively connected to the upper side and the outside of the base frame set 1. The second blocking plate 91 assembled on the upper side of the top frame set 2 as shown in FIG. 23.

The door plate set 7 is then connected between the base frame set 1 and the top frame set 2.

Figure 21:
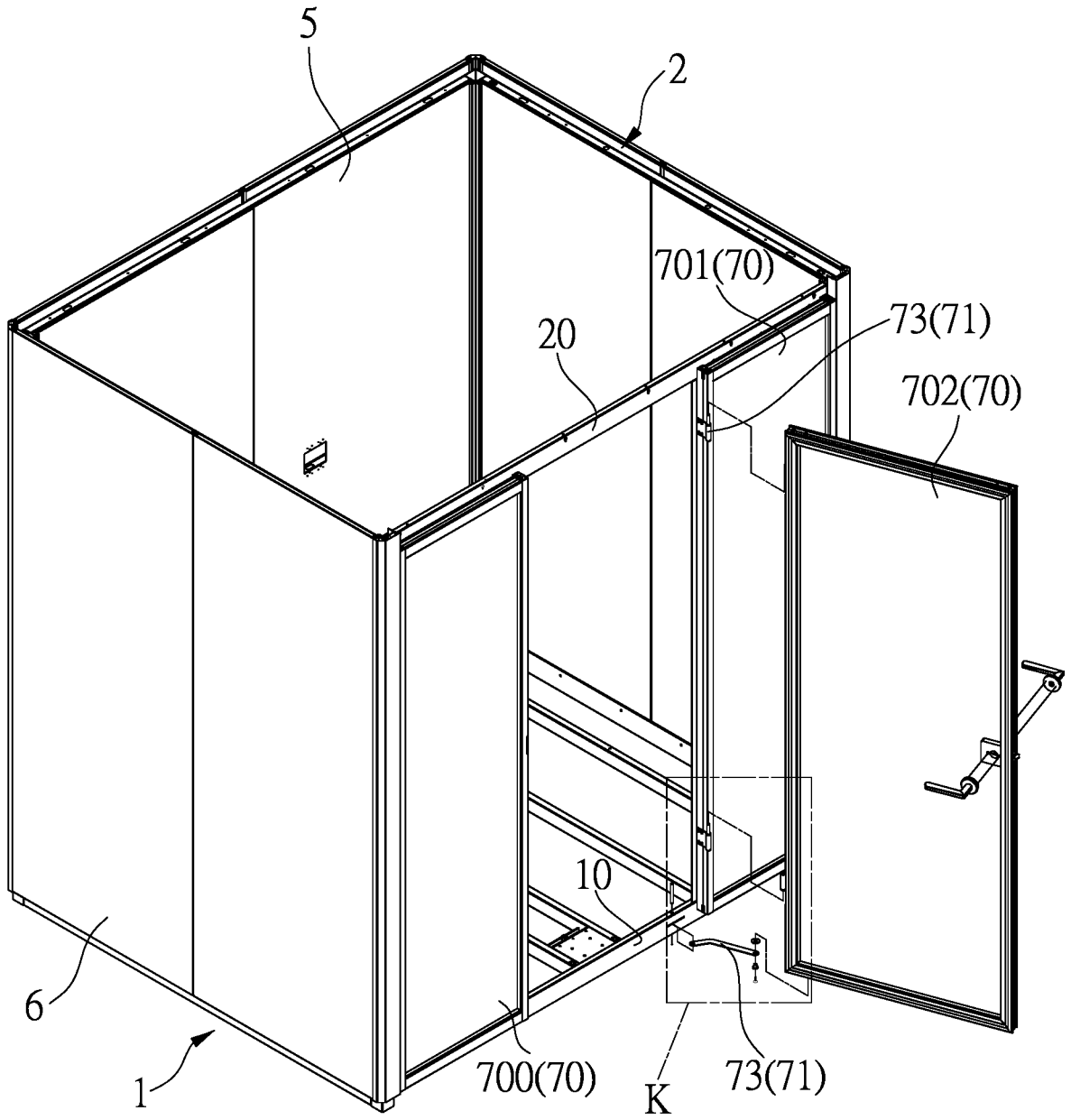
FIG. 21 is a first embodiment of the door plate set to be connected to the assembly component.
Figure 22:
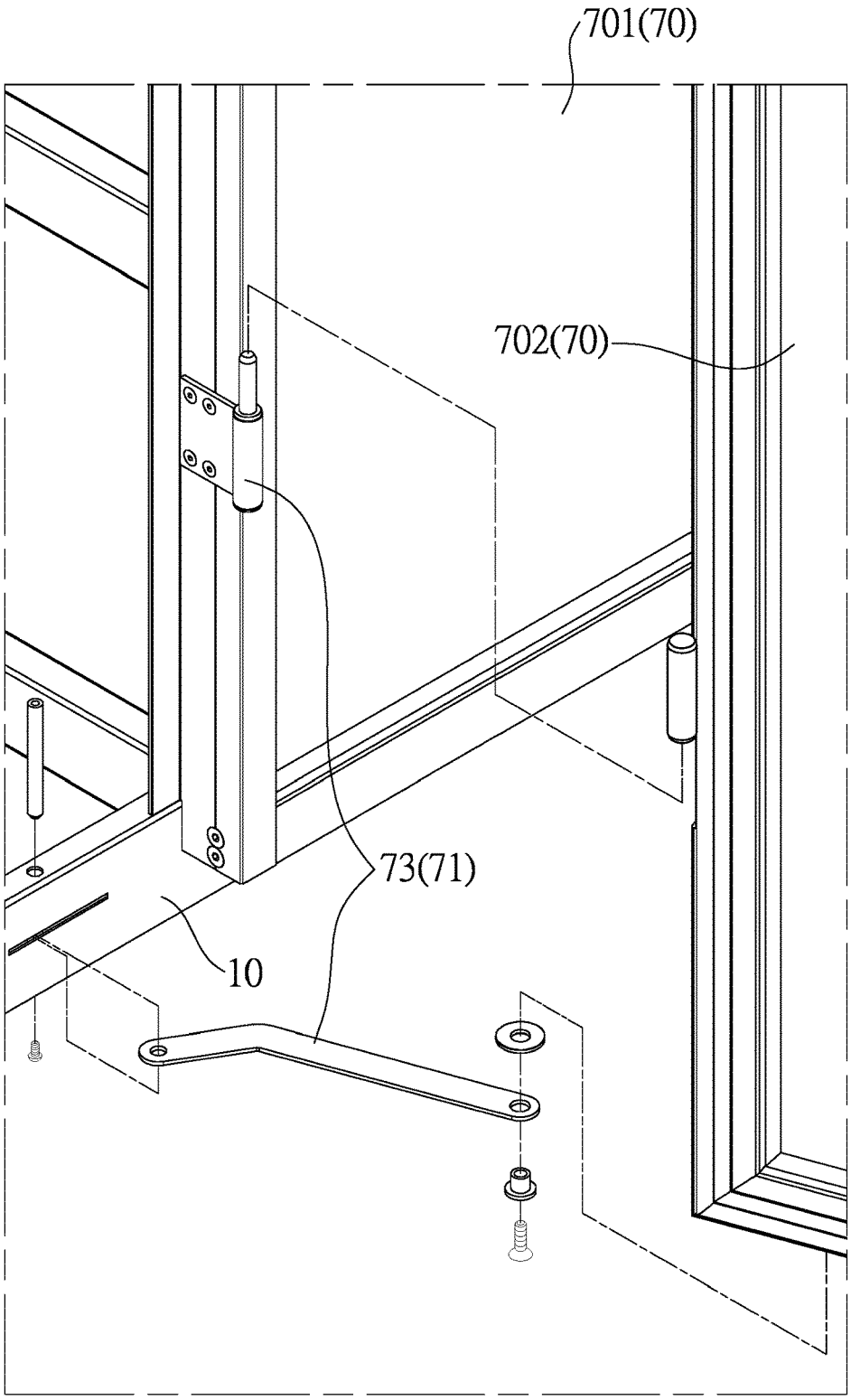
FIG. 22 is an enlarged view of the area "K" in FIG. 21.

It is noted that the door plate set 7 includes two different embodiments. As shown in FIGS. 21 and 22, the first embodiment shows that the first and second plates 700, 701 are connected between the first base frame 10 of the base frame set 1 and the first top frame 20 of the top frame set 2. The assembly component 71 is a hinge 73 which is connected between the second and third plates 701, 702 respectively. The third plate 701 can be opened or closed relative to the second plate 701.

Figure 25:
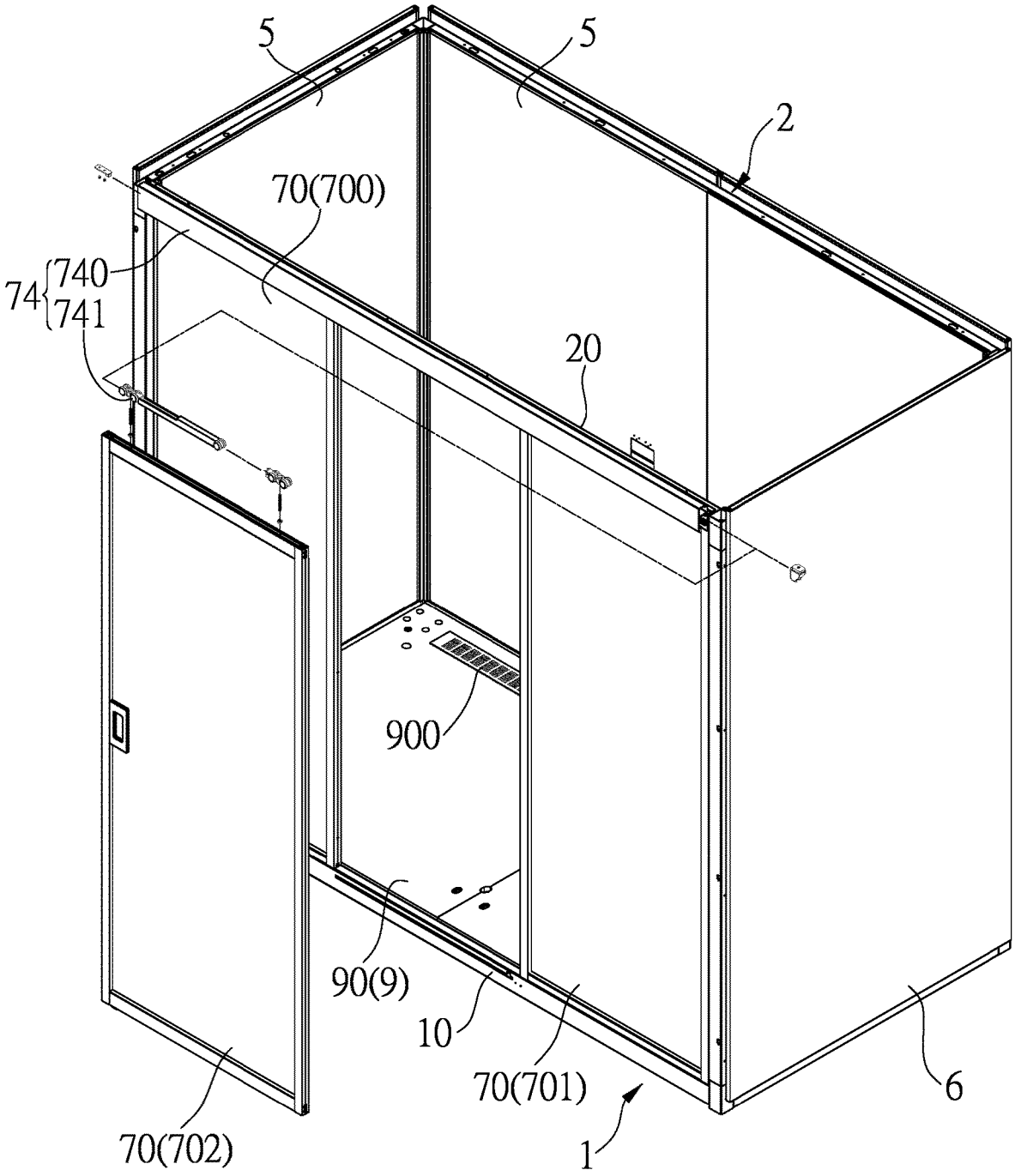
FIG. 25 is a second embodiment of the door plate set to be connected to the assembly component.
Figure 26:
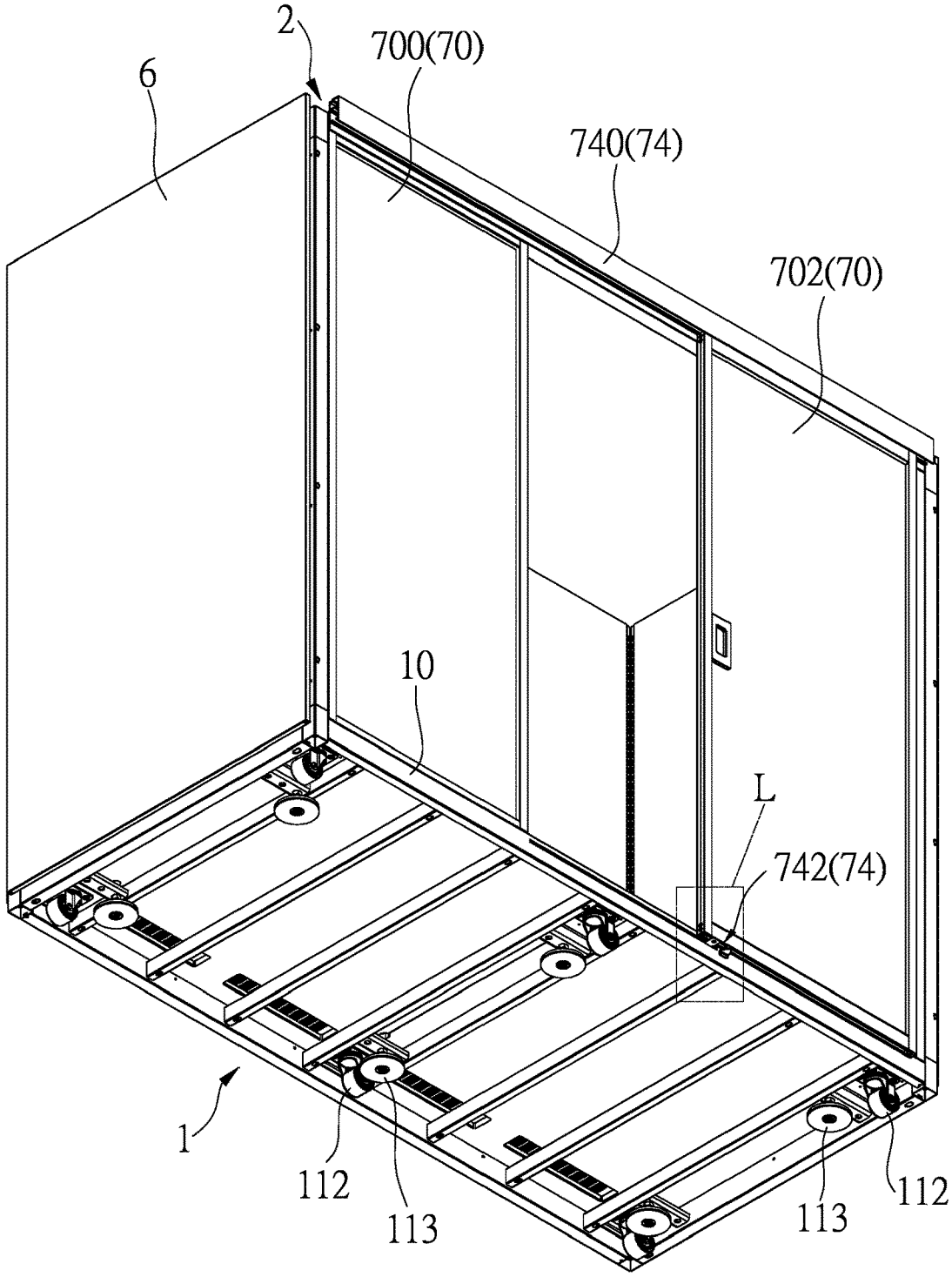
FIG. 26 is another view of the second embodiment of the door plate set to be connected to the assembly component.
Figure 27:
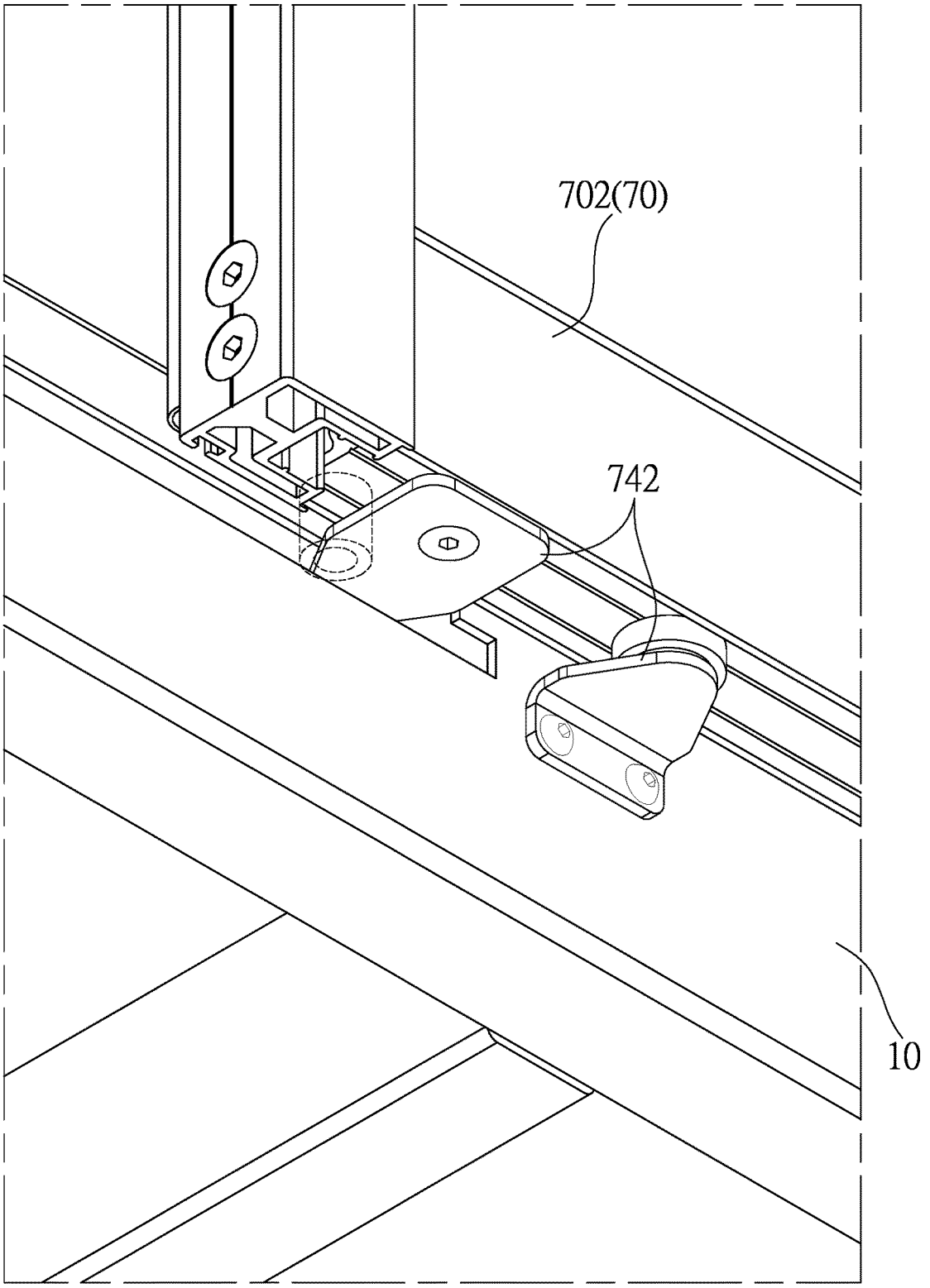
FIG. 27 is an enlarged view of the area "L" in FIG. 26.
Figure 28:
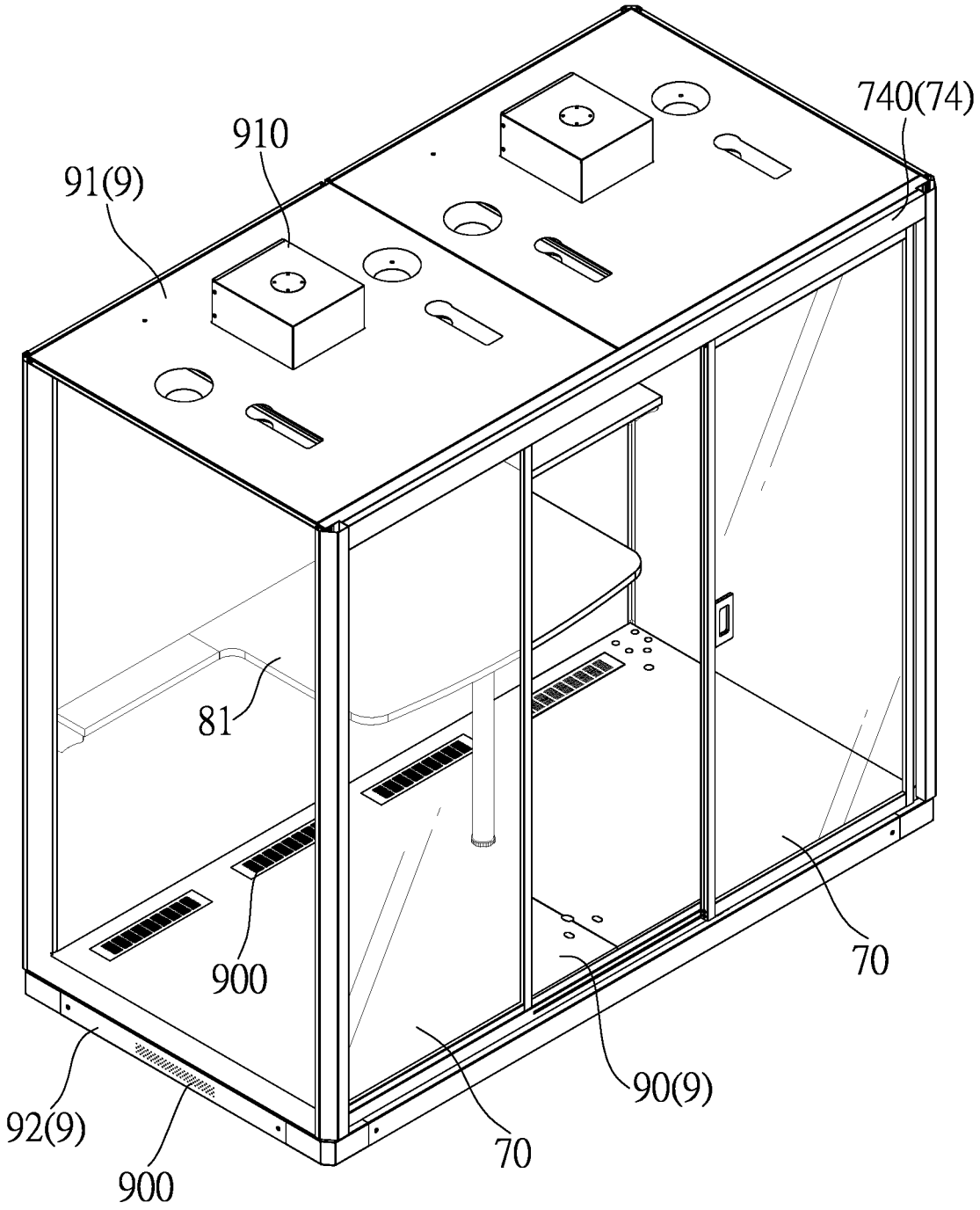
FIG. 28 shows that an office component is installed in the mobile office.

As shown in FIGS. 25 to 27, the second embodiment is that the first and second plates 700, 701 are connected between the first base frame 10 of the base frame set 1 and the first top frame 20 of the top frame set 2. The assembly component 71 is a rail assembly 74. The rail assembly 74 is located between the first, second and third plates 700, 701, 702 and the first base frame 10 and the first top frame 20. The rail assembly 74 includes a rail 740 connected to the first top frame 20, a slider 741 assembled between the third plate 702 and the rail 740, and a roller 742 assembled between the third plate 702 and the base frame 10. Therefore, the third plate 702 is slidable relative to the first and second plates 701, 702.

The mobile office structure can be assembled by the users without special tools, and the mobile office structure can be easily assembled by some easy steps. By the wheel set 110 including the wheel 112 and the disk 13 installed to the base frame set 1, the users mobile office can be moved to a desired position. Besides, the inner plates 8 are connected with different office components 81, and the outer plates 6 have ports 61 to enhance the functions of the mobile office.

While we have shown and described the embodiment in accordance with the present invention, it should be clear to those skilled in the art that further embodiments may be made without departing from the scope of the present invention.

What is claimed is:

1. A mobile office structure comprising:

a base frame set (1) including a plurality of first base frames (10) and a plurality of second base frames (11) mutually perpendicular and horizontally arranged, each of the first base frames (10) having a first end part (100) protruding upward from each of two ends thereof;

a plurality of first fastening components (12) each having a first fastening seat (120) formed on the first base frame (10), a first fastening hole (121) formed to the second base frame (11), and a first bolt (122) connected to the first fastening seat (120) and the first fastening hole (121);

a top frame set (2) having a plurality of first top frames (20) and a plurality of second top frames (21) that are mutually perpendicular and horizontally arranged, each of the first top frames (20) having a second end part (200) protruding downward from each of two ends thereof;

a plurality of second fastening components (22) each having a second fastening seat (220) formed on the first top frame (20), a second fastening hole (221) formed to the second top frame (21), and a second bolt (222) connected to the second fastening seat (220) and the second fastening hole (221);

a plurality of wheel sets (110) connected to an underside of each of the second base frames (11);

multiple upright frames (3) each having an opening (30) formed in each of two ends thereof, the two openings (30) located corresponding to the first end part (100) and the second end part (200), the first and second end parts (100, 200) respectively inserted into the openings (30) corresponding thereto, so that the upright frames (3) are vertically assembled between the base frame sets (1) and the top frame sets (2), and are located at four corners of a combination of the base frame sets (1) and the top frame sets (2), each upright frame (3) having multiple slots (31);

multiple separators (4) each having a segment (40) that is connected to the slots (31) of each upright frame (3) so that each separator (4) is connected between the two upright frames (3), each separator (4) having multiple first holes (41) and multiple second holes (42) formed in a top side thereof;

multiple linings (5) each having multiple first blocks (50) engaged with the first holes (41) corresponding thereto, so that each lining (5) is assembled between the two upright frames (3) and located corresponding to an inside of each separator (4), each lining (5) having multiple first magnetic parts (51) attached thereto;

multiple outer plates (6) each having multiple second blocks (60) which are engaged with the second holes (42) correspondingly, so that each outer plate (6) is assembled between the two upright frames (3) and is located relative to an outside of each separator (4);

a blocking plate set (9) including multiple first blocking plates (90), multiple second blocking plates (91) and multiple third blocking plates (92), each first blocking plate (90) and each third blocking plate (92) respectively assembled on an upper side and an outside of the base frame set (1), the second blocking plate (91) assembled on an upper side of the top frame set (2), and a door plate set (7) having multiple door plates (70) and an assembly component (71) that is installed between the base frame set (1) and the top frame set (2).

2. The mobile office structure as claimed in claim 1, wherein each of the wheel sets (11) includes a wheel seat (111) which has a wheel (112) and a disk (113) connected to an underside thereof.

3. The mobile office structure as claimed in claim 1, wherein the first end part (100) includes a first positioning hole (101), the second end part (200) includes a second positioning hole (201), a third bolt (32) is connected to the first and second positioning holes (101, 201).

4. The mobile office structure as claimed in claim 1, wherein each outer plate (6) has multiple ports (61) formed to an outside thereof.

5. The mobile office structure as claimed in claim 1, wherein the door plates (70) include a first plate (700), a second plate (701) and a third plate (702), the first and second plates (700, 701) are connected between the first base frame (10) and the first top frame (20), the assembly component (71) is a hinge (73) which is connected to the second and third plates (701, 702) respectively.

6. The mobile office structure as claimed in claim 1, wherein the door plates (70) include a first plate (700), a second plate (701) and a third plate (702), the first and second plates (700, 701) are connected between the first base frame (10) and the first top frame (20), the assembly component (71) is a rail assembly (74) which is connected to the second and third plates (701, 702) respectively, the rail assembly (74) includes a rail (740) connected to the first top frame (20), a slider (741) assembled between the third plate (702) and the rail (740), and a roller (742) assembled between the third plate (702) and the base frame (10).

7. The mobile office structure as claimed in claim 1, wherein each of the first blocking plates (90) and each of the third blocking plates (92) includes multiple vents (900).

8. The mobile office structure as claimed in claim 1, wherein each of the second blocking plates (91) has multiple fire distinguishers (910).

9. The mobile office structure as claimed in claim 1 further comprising multiple inner plates (8), and each inner plate (8) including multiple second magnetic parts (80) which are located corresponding to the first magnetic parts (51) of the lining (5) corresponding thereto, the first and second magnetic parts (51, 80) magnetically attract each other to attach the inner plates (8) to an inside of the linings (5).

10. The mobile office structure as claimed in claim 9, wherein each of the inner plates (8) has an office component (81) connected thereto.

* * * * *